US009373236B2

(12) United States Patent
Oehl et al.

(10) Patent No.: US 9,373,236 B2
(45) Date of Patent: Jun. 21, 2016

(54) SYSTEMS AND METHODS FOR SECURING HANDHELD ELECTRONIC DEVICES

(71) Applicant: Apple Inc., Cupertino, CA (US)

(72) Inventors: Wilhelm Oehl, San Francisco, CA (US); Erik Anderson, San Francisco, CA (US); Edmond Kuan, San Francisco, CA (US); Joe Nobles, San Francisco, CA (US); Kambiz Ahmadi, San Francisco, CA (US); Isao Takezawa, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/327,225

(22) Filed: Jul. 9, 2014

(65) Prior Publication Data

US 2014/0340226 A1 Nov. 20, 2014

Related U.S. Application Data

(63) Continuation of application No. 12/968,218, filed on Dec. 14, 2010, now abandoned.

(60) Provisional application No. 61/286,145, filed on Dec. 14, 2009.

(51) Int. Cl.

| | |
|---|---|
| ***G08B 13/12*** | (2006.01) |
| ***G08B 13/22*** | (2006.01) |
| ***G08B 13/14*** | (2006.01) |

(52) U.S. Cl.

CPC ..... *G08B 13/22* (2013.01); *G08B 13/1445* (2013.01); *G08B 13/1463* (2013.01)

(58) Field of Classification Search

CPC ..... G08B 13/14; G08B 13/1445; G08B 21/0213; G08B 13/1463; G08B 13/1418; G08B 13/1409; G08B 15/004; G06F 21/88; E05B 73/00; E05B 45/005; G03B 17/561

USPC ..... 340/568.1–568.4, 568.8; 24/453, 454; 174/68.1; 53/507, 508

See application file for complete search history.

(56) References Cited

U.S. PATENT DOCUMENTS

| | | | | |
|---|---|---|---|---|
| 3,789,130 | A * | 1/1974 | Parker | 174/115 |
| 4,539,739 | A * | 9/1985 | Himmelberger et al. | 29/564.1 |
| 5,906,031 | A * | 5/1999 | Jensen | 24/3.12 |
| 6,147,603 | A | 11/2000 | Rand | |
| 6,476,717 | B1 * | 11/2002 | Gross et al. | 340/568.1 |
| 6,690,277 | B1 | 2/2004 | Hansen et al. | |
| 7,053,774 | B2 | 5/2006 | Sedon et al. | |
| 7,209,038 | B1 | 4/2007 | Deconinck et al. | |
| 7,627,343 | B2 | 12/2009 | Fadell et al. | |
| 7,710,266 | B2 * | 5/2010 | Belden et al. | 340/568.3 |

(Continued)

*Primary Examiner* — Kerri McNally

(74) *Attorney, Agent, or Firm* — Sterne, Kessler, Goldstein & Fox P.L.L.C.

(57) ABSTRACT

Systems and methods are provided for securing handheld electronic devices. To provide an optimal shopping experience for consumers, handheld electronic devices must be made accessible to users, while simultaneously being secured to prevent theft. A security system can include a coupler connected to an electronic device. The coupler can include a connector operative to provide power and/or data to the electronic device. A cable transferring the power and data can also include an alarm path and a security cable for providing security. The security cable may be difficult to cut, and the alarm path can direct an alarm to sound if the cable is cut or if the electronic device is disconnected from the coupler.

14 Claims, 23 Drawing Sheets

(56) References Cited

U.S. PATENT DOCUMENTS

| | | | | |
|---|---|---|---|---|
| 7,724,135 | B2 * | 5/2010 | Rapp et al. | 340/568.1 |
| 8,145,821 | B2 * | 3/2012 | Mead et al. | 710/303 |
| 8,242,906 | B2 * | 8/2012 | Fawcett | 340/568.2 |
| 2007/0024239 | A1 * | 2/2007 | Park | 320/114 |
| 2007/0079566 | A1 | 4/2007 | Neill et al. | |
| 2009/0009329 | A1 * | 1/2009 | Edun et al. | 340/568.4 |
| 2012/0280810 | A1 * | 11/2012 | Wheeler | 340/539.11 |

* cited by examiner

Easy to cut security cable

Cable mess

Fixture alarm not effective

Stand out of scale

Mounted - Restricted range of motion

Behind Glass - Inaccessible

On device

On dock / stand

On fixture

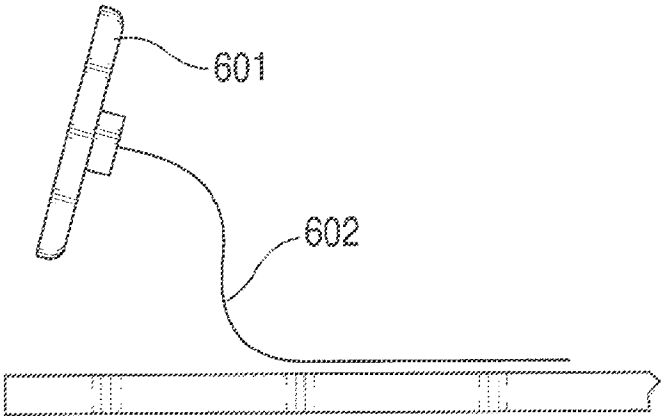
Loose
FIG. 6A
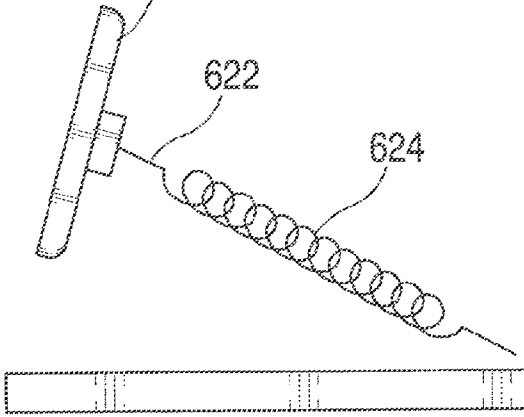
Mechanical Recoiler
FIG. 6B
Coil
FIG. 6C

SYSTEMS AND METHODS FOR SECURING HANDHELD ELECTRONIC DEVICES

CROSS-REFERENCE TO RELATED APPLICATIONS

This application is a continuation of U.S. patent application Ser. No. 12/968,218, filed Dec. 14, 2010, which claims the benefit of previously filed U.S. Provisional Patent Application No. 61/286,145, entitled "Systems and Methods for Securing Handheld Electronic Devices," filed Dec. 14, 2009, entitled "Methods and Systems for Securing Handheld Electronic Devices." Each of these applications is incorporated herein in its entirety by reference thereto.

FIELD OF THE INVENTION

This can relate to systems and methods for securing handheld electronic devices and, more particularly, to systems and methods for securing handheld electronic devices to fixtures while also coupling such devices to power and data transfer cables.

BACKGROUND OF THE DISCLOSURE

Handheld and mobile electronic devices are sold using several different sales channels. For example, some devices are sold on-line or via mail order. In these cases, devices are stored in a warehouse or distribution center prior to sale, and subsequently mailed to a purchaser following a transaction. As another example, some devices may be sold at a retail point of sale. A consumer may then look at the device within the packaging, and in some cases open the packaging to try the device. Alternatively, one or more test devices may be provided for consumers to try before purchasing. In particular, at Apple stores operated by Apple inc., of Cupertino Calif., several electronic devices may be provided on tables for consumers to try. The devices may be secured to the tables to prevent theft.

SUMMARY OF THE DISCLOSURE

Systems and methods are provided for securing handheld electronic devices in a retail environment. In particular, systems and methods are provided by which an electronic device can be secured to a fixture while it can also be coupled to one or more sources for both power and data transfers.

A security system can include a coupler connected to an electronic device, and a cable connecting the coupler to a fixture. The cable can include a security element for preventing theft, as well as an electronic path for transferring at least one of data and power to the electronic device. In some cases, the coupler can include a connector operative to mate with the electronic device such that data provided through the cable and coupler can reach the electronic device.

BRIEF DESCRIPTION OF THE DRAWINGS

The above and other aspects of the invention, its nature, and various features will become more apparent upon consideration of the following detailed description, taken in conjunction with the accompanying drawings, in which like reference characters refer to like parts throughout, and in which:

FIGS. 6A-6C are diagrams of different cabling options for a handheld electronic device security system, in accordance with some embodiments of the invention;

DETAILED DESCRIPTION OF THE DISCLOSURE

Figure 1:
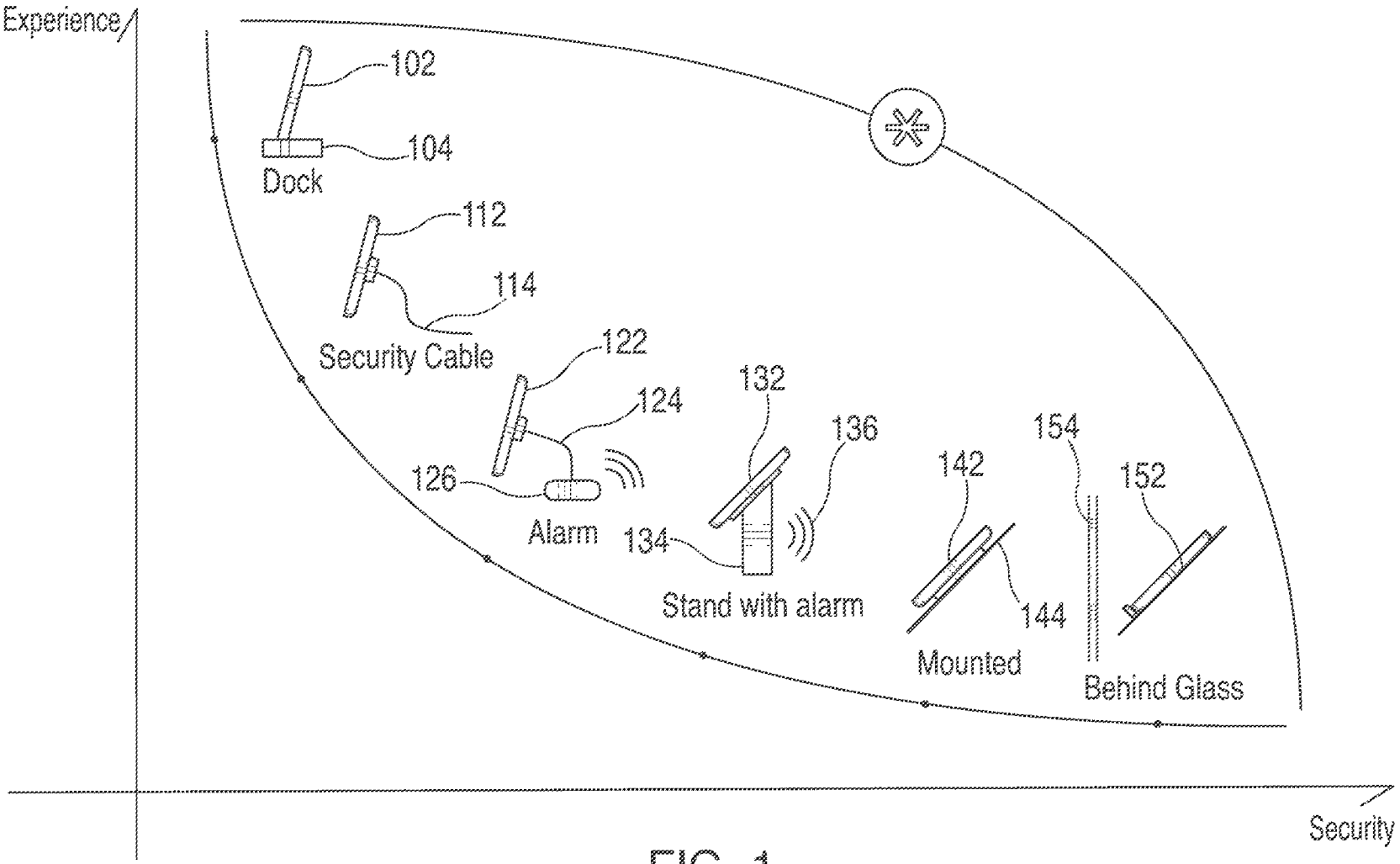
FIG. 1 is simplified diagram showing a range of security options for a handheld electronic device, in accordance with some embodiments of the invention.

Systems and methods designed to deter theft of electronic devices while on display at retail locations are provided. More particularly, systems and methods are provided for securing portable handheld electronic devices, such as cellular telephones, media players, personal digital assistants ("PDAs"), tablets, and the like to a fixture in a store while still providing a superior user experience with the portable handheld electronic device. A user may be able to hold, play with, or use the handheld electronic device while the device remains secured to the fixture to prevent theft.

One example of a security device may include a stand with a security tether that may attach to the handheld electronic device. The stand may in turn be affixed to a fixture, such as a table, shelf, or counter. As a result, the handheld device may be secured to the fixture, thereby deterring theft. In some embodiments, the security device may further include an alarm feature that can create an alarm event when the security tether is severed. In some embodiments, the security device may include a connector that can mate with a connector of the handheld electronic device and that may be operatively coupled to a host system to provide a conductive path or a powered path between the host device and the electronic device. In some cases, the security system may include a coupler that can serve as a node for attachment to a handheld electronic device and a coupling point to the stand. The coupler may also carry a cable and help integrate the connector electrical lines with the security tether. In some cases, the coupler can include or be connected to the connector used to establish a communications path with the handheld electronic device.

Embodiments of the invention are discussed below with reference to figures. However, those skilled in the art will readily appreciate that the detailed description given herein with respect to these figures is for explanatory purposes as the invention extends beyond these embodiments. For example, although many of the figures are described with reference to a handheld electronic device, many embodiments may be used with non-portable devices. The term "electronic device" can include, but is not limited to, music players, video players, still image players, game players, other media players, music recorders, video recorders, cameras, other media recorders, radios, medical equipment, domestic appliances, transportation vehicle instruments, calculators, cellular telephones, other wireless communication devices, personal digital assistants ("PDAs"), programmable remote controls, pagers, laptop computers, tablets, desktop computers, printers, and combinations thereof. In some cases, the electronic device may perform single function (e.g., a device dedicated to playing music) and, in other cases, the electronic device may perform multiple functions (e.g., a device that plays music, displays video, stores pictures, and receives and transmits telephone calls). Moreover, in some cases, the electronic device may be any portable, mobile, hand-held, or miniature electronic device that allows a user to use the device wherever the user travels. Alternatively, an electronic device of the invention may not be portable at all, but may instead be generally stationary, such as a desktop computer or television.

In view of the foregoing, systems and methods for securing an electronic device are provided and described with reference to FIGS. 1-21.

FIG. 1 is a simplified diagram showing a range of security options for an electronic device with varying degrees of user experience and security. Each security system or display mechanism for providing an electronic device in a retail environment may typically require a tradeoff between consumer experience and security to prevent theft. In particular, a good consumer experience may be one that allows a user to freely use the device without restriction as he or she decides to make a purchase. For example, a consumer may want to pick up a device, turn it around to see it from different angles, place it in a pocket or bag to check portability, verify the effectiveness of user interfaces, or perform other actions that emulate typical use of the device. Allowing such a free use experience, however, comes at a substantial security risk, as a consumer having a free use experience will be subject to no restraint preventing the consumer from stealing the device. As a result, an ideal security system will provide an experience as close to a free use experience as possible while maintaining a substantial barrier to theft.

in FIGS. 1 and 2, several types of security systems are laid out, along with their inconveniences. A first option can include placing a handheld electronic device 102 freely within a docking station 104. A consumer may simply pick up device 102 to manipulate and try it. Device 102, however, is not retained or monitored in any way, and may therefore very easily be stolen or removed without notice. A second option can include securing a handheld electronic device 112 to a cable 114. This may allow a consumer to hold and use device 112 while keeping it physically secured. Although this approach may decrease free use for a consumer, the limits to the consumer's experience are reduced and therefore may allow for a satisfactory consumer experience. This approach, however, may still require a significant tradeoff between the consumer experience and security. In particular, as shown in FIG. 2A, if a cable 204 securing an electronic device 202 is small to improve a consumer's experience, cable 204 may be easily cut. If the cable is too large to cut, the consumer's experience may be adversely affected because the cable may require a large force for it to bend or move. In some cases, this approach may also require a large number of cables connected to the device. For example, as shown in FIG. 2B, a device 212 secured by a cable 214 may also include a headphone cable 216 and a power or data cable 218 for exchanging certain types of signals. The resulting display may then include three distinct cables, which may distract the user from device 212, and may even cause tangling, which may affect the user's experience.

Figure 2A:
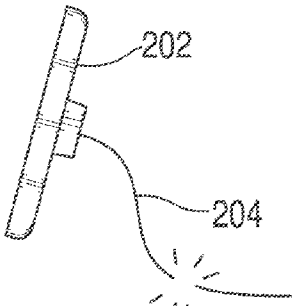
FIGS. 2A-2F are simplified diagrams showing different security options for a handheld electronic device, in accordance with some embodiments of the invention.
Figure 2B:
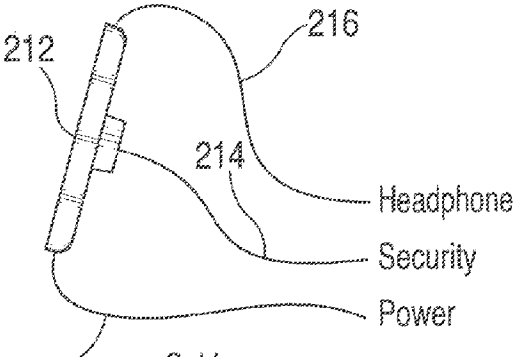
Figure 2C:
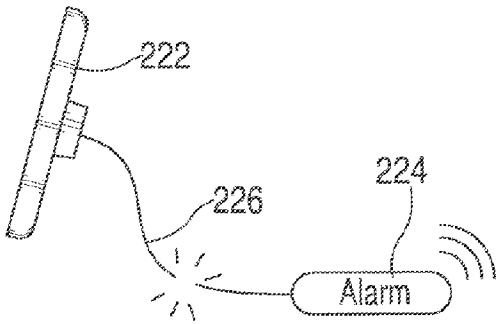

A third option, as shown in FIG. 1, can include coupling a handheld electronic device 122 to an alarm 124, for example, at an end of a cable 126. Alarm 124 may be configured to sound loudly if electronic device 122 is disconnected from alarm 124 (e.g., if cable 126 coupling device 122 to alarm 124 is cut or decoupled in some way). Alarm 124 may alert security at a retail location to stop a perpetrator, but as shown in FIG. 2C, an alarm 224 may not prevent anyone from cutting cable 226 or otherwise decoupling cable 226 from a device 222 and/or alarm 224 and then attempting to escape from the retail location with electronic device 222.

Figure 2D:
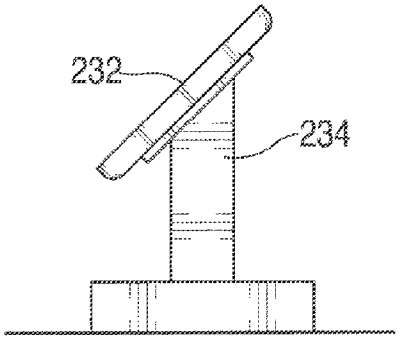

A fourth option, as shown in FIG. 1, can include coupling a handheld device 132 to a stand 134 that may also include an alarm 136 operative to sound if device 132 is removed from stand 134. This approach may allow device 132 to be presented at a desirable perspective (e.g., at a perspective or angle that allows a user to best interact with device 132), while also discouraging theft by alarm 136. However, this approach may have limitations however. First, as shown in FIG. 2D, for example, a stand 234 may be out of scale relative to a device 232, thus making the presentation aesthetically unpleasing. Second, an alarm associated with stand 234 and device 232 may provide limited security for device 232.

Figure 2E:
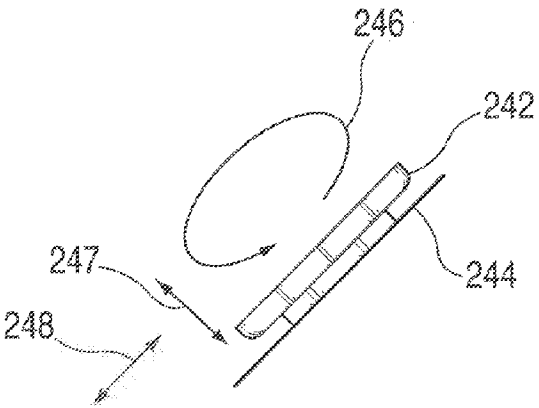
Figure 2F:
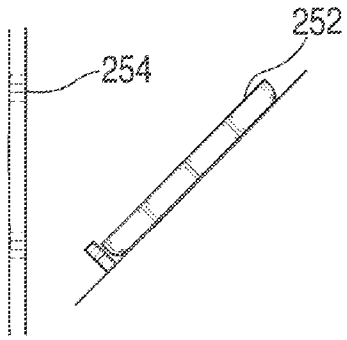

As also shown in FIG. 1, a fifth option can include fixedly mounting an electronic device 142 to a surface 144 of a fixture or stand. In some cases, device 142 may be mounted such that it can move along surface 144 along one or more limited axes of movement. For example, as shown in FIG. 2E, an electronic device 242 can be mounted such that it may rotate within a plane of a mounting surface 244 as indicated by arrow 246, but may not be removed from surface 244 (e.g., no movement in the directions or arrows 247 or 248). This approach, however, may prevent a consumer from holding device 242, and may restrict the consumer's range of motion for using device 242 in the retail environment. As shown in FIG. 1, a sixth option can include placing a handheld electronic device 152 behind a window 154. Unfortunately, this may not allow a user to hold or use device 152, as device 152 is physically inaccessible, as also shown in FIG. 2F by a device 252 and a window 254.

Figure 3A:
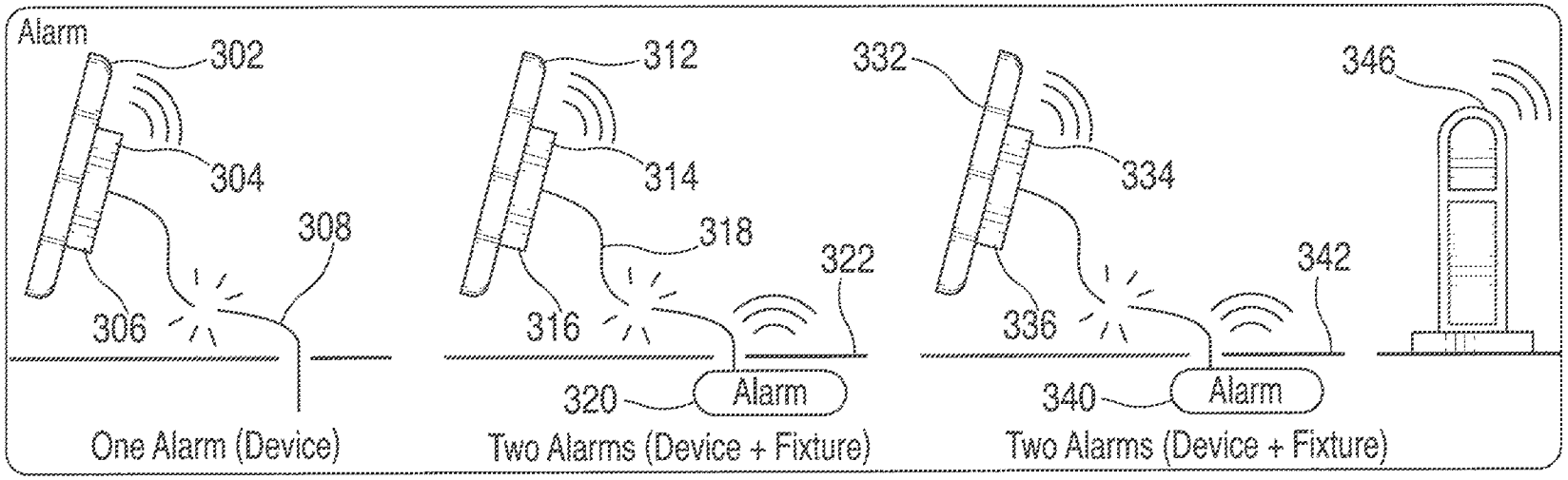
FIGS. 3A and 3B are diagrams showing data and alarm connectivity for a handheld electronic device, in accordance with some embodiments of the invention.

FIG. 3A is diagram showing alarm connectivity for a handheld electronic device in accordance with several embodiments of the invention. In some embodiments, an alarm may be situated within or on a handheld electronic device. For example, as shown in FIG. 3A, an electronic device 302 can include an alarm 304. In some cases, alarm 304 can be carried by or otherwise coupled to a coupler 306 that may be secured to electronic device 302. Coupler 306 can be coupled to a cable 308 for securing device 302. Alarm 304 can be configured to sound when cable 308 is cut or decoupled from coupler 306 or alarm 304. In other embodiments, as also shown in FIG. 3A, an electronic device 312 can include a first alarm 314 that can be carried by or otherwise coupled to a coupler 316 that may be secured to electronic device 312, while a second alarm 320 may be integrated with or coupled to a fixture 322. Alarms 314 and 320 may be coupled to one another via a cable 318. In this manner, both electronic device 312 and fixture 322 may emit a sound when cable 318 is cut or otherwise decoupled from one or more of alarm 314, coupler 316, alarm 320, and fixture 322. In yet other embodiments, as also shown in FIG. 3A, an electronic device 332 can include a first alarm 334 carried by or otherwise coupled to a coupler 336, which can be secured to device 332, while a second alarm 340 may be integrated with or otherwise coupled to a fixture 342, and while a third alarm 346 may be placed within a retail location to detect when electronic device 332 passes near alarm 346 (e.g., when electronic device 332 passes through a gate). In some cases, alarm 346 can be placed near an entrance or exit of a retail location.

Figure 3B:
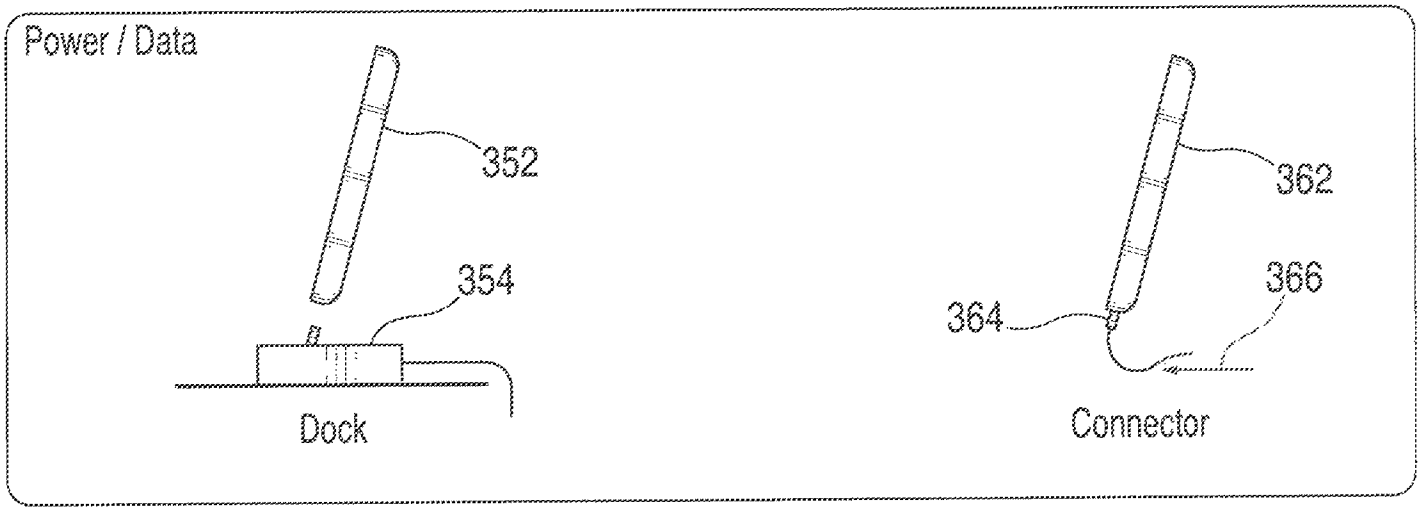

FIG. 3B is a diagram showing power/data connectivity for a handheld electronic device. In some embodiments, a device 352 can be electrically coupled to a host device or to a power supply via a docking station 354. Docking station 354 may, for example, include a cavity for receiving a portion of device 352 and supporting device 352 in an upright position. In some cases, docking station 354 can be coupled to other components for providing additional functionality to device 352 (e.g., speakers or a video projector). Docking station 354 may include a connector that can engage a corresponding connector of device 352 when device 352 is placed inside the cavity of docking station 354. It should be appreciated that a cavity is not a limitation and that device 352 may simply be mounted to the connector itself or may possibly rest on a surface rather than be placed in a cavity of docking station 354. In other embodiments, as shown in FIG. 3B, a device 362 may simply be coupled to a host device via a connector 364 and a cable 366. In some cases, a connector of docking station 354, connector 364, device 352 or device 362, or combinations of these, can include a latching mechanism for securing the connectors together. In some cases, the latching mechanism can be removable to release the device from the docking station or cable, although in other cases it may maintain the device secured to the docking station or cable.

Figure 4A:
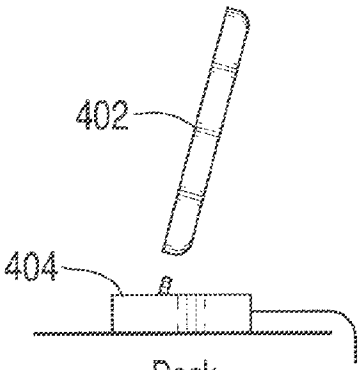
FIGS. 4A-4D are diagrams showing docking options for a handheld electronic device, in accordance with some embodiments of the invention.
Figure 4B:
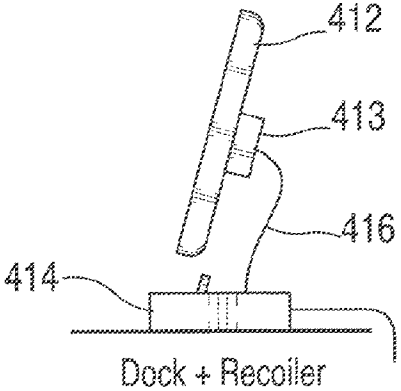

FIGS. 4A-4D are diagrams showing docking options for a handheld electronic device in accordance with several embodiments of the invention. In some embodiments, as shown in FIG. 4A, for example, a handheld electronic device 402 may be freely connectable with a docking station 404. That is, electronic device 402 may not be restrained to docking station 404, and a consumer can freely pick up and try electronic device 402 as if it had been purchased. In other embodiments, as shown in FIG. 4B, for example, a handheld electronic device 412 can be left free to connect to or disconnect from a docking station 414, but may be tethered to docking station 414 by a cable 416. Cable 416 may be fixed to handheld electronic device 412 and to a fixture, such as docking station 414, to limit a range of motion of device 412 in the retail environment (e.g., with respect to docking station 414). Cable 416 may be attached to handheld electronic device 412 using different approaches including, for example, via a coupler 413 that may be glued, fastened, locked, or otherwise attached to handheld electronic device 412. The interface between electronic device 412 and coupler 413 can be selected to be substantially permanent. In some embodiments, cable 416 may be movably coupled to docking station 414 such that cable 416 can be moved between a non-extended state (e.g., a short state) and an extended state (e.g., a long state). Based on the state of cable 416, the range at which electronic device 412 can be moved can change. This can allow a consumer to pick up device 412 so that they can freely use device 412 with a reduced restraint while keeping device 412 secured to docking station 414 or to a fixture. In some embodiment, the moving action of cable 416 may be biased with a recoiler. The recoiler may be configured to continually pull (e.g., bias) cable 416 in a non-extended state. This may be accomplished, for example, with a spring action.

Figure 4C:
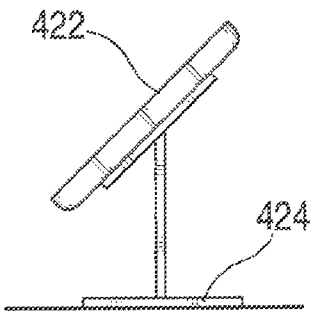
Figure 4D:
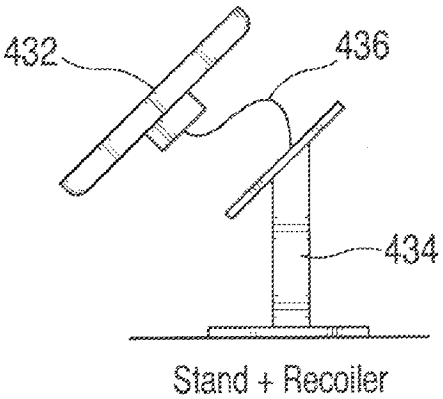

In other embodiments, as shown in FIG. 4C, for example, a handheld electronic device 422 may be configured to rest on a stand 424. In such embodiments, electronic device 422 may not be attached or coupled to stand 424 and, therefore, may be freely used by a consumer without restraint. In other embodiments, as shown in FIG. 4D, for example, an electronic device 432 may be movably constrained to a stand 434 via a cable 436. As described above in connection with other embodiments, cable 436 may be attached to electronic device 432 and to stand 434 or any other fixture in a retail environment. Cable 436 may contain slack or it may be configured to move relative to stand 434. Cable 436 may also include a recoiler so as to reduce slack (e.g., continuously bias cable 436 in a non-extended state).

Figure 5A:
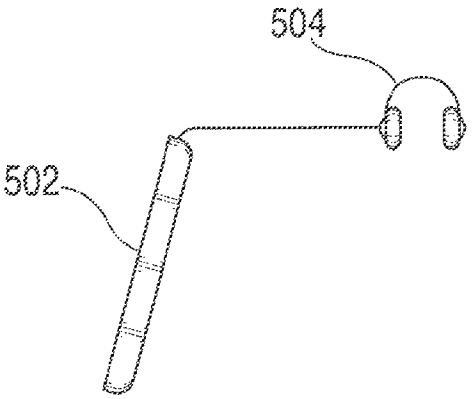
FIGS. 5A-5C are diagrams showing earphone connectivity for a handheld electronic device, in accordance with some embodiments of the invention.
Figure 5B:
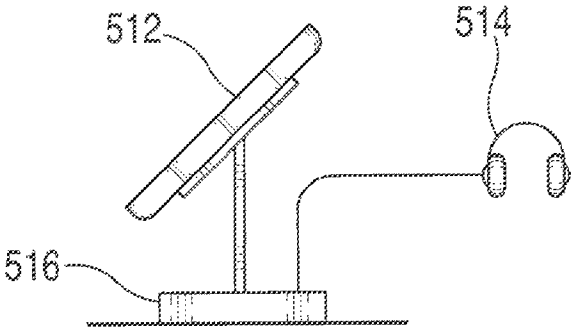
Figure 5C:
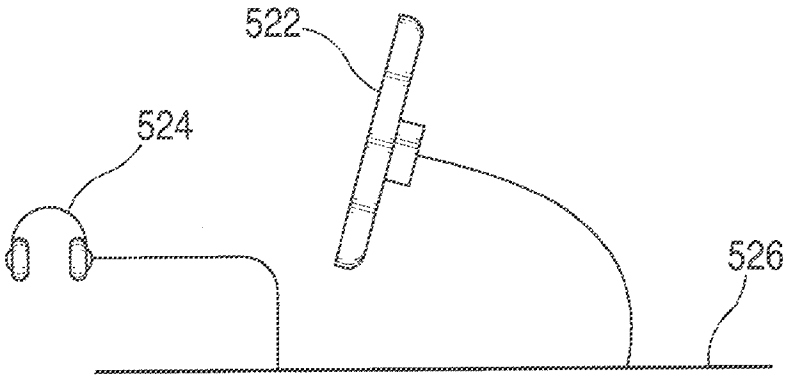

FIGS. 5A-5C are diagrams showing accessory (e.g., earphone) connectivity for a handheld electronic device in accordance with several embodiments of the invention. In some embodiments, as shown in FIG. 5A, for example, earphones 504 may be connected to a handheld electronic device 502. This may be accomplished, for example, with a cable jack that can be mated with a corresponding receptacle on handheld electronic device 502. In other embodiments, as shown in FIG. 5B, for example, earphones 514 may be connected to a docking station or stand 516 rather than directly to a handheld electronic device 512. Stand or docking station 516 can serve to transfer signals between electronic device 512 and earphones 514. In other embodiments, as shown in FIG. 5C, for example, earphones 524 may be connected to a handheld electronic device 522 through a fixture 526 rather than through an intermediate device such as a stand or docking station.

FIGS. 6A-6C show different cabling options for a handheld electronic device security system, in accordance with several embodiments of the invention. In all of these embodiments, a cable may be used to secure the handheld electronic device to a fixture inside a store (e.g. a table). In each of these embodiments, the cable may provide free use of the handheld electronic device relative to the fixture, or to another fixed object to which the device is connected (e.g., a docking station or a stand). In some embodiments, as shown in FIG. 6A, for example, a cable 602 may be provided with slack. That is, cable 602 may be provided at an extended length (e.g., loose).

The length may be enough for a consumer to pick up and adequately use a handheld electronic device 601 coupled to cable 602. In other embodiments, as shown in FIG. 6B, for example, a cable 612 coupled to a device 611 may be provided with a mechanical recoiler 614 that can allow cable 612 to extend while also providing a force for drawing cable 612 back to a non-extended state. In yet other embodiments, as shown in FIG. 6C, for example, a cable 622 coupled to a device 621 may be configured with a coil 624 or a series of tight spirals that allow cable 622 to extend past its nominal state while limiting the cable slack when device 621 is not in use. The numbers and size of the spirals may be widely varied, but may typically provide an extended length that is adequate to allow a consumer to use and hold device 621.

Figure 7C:
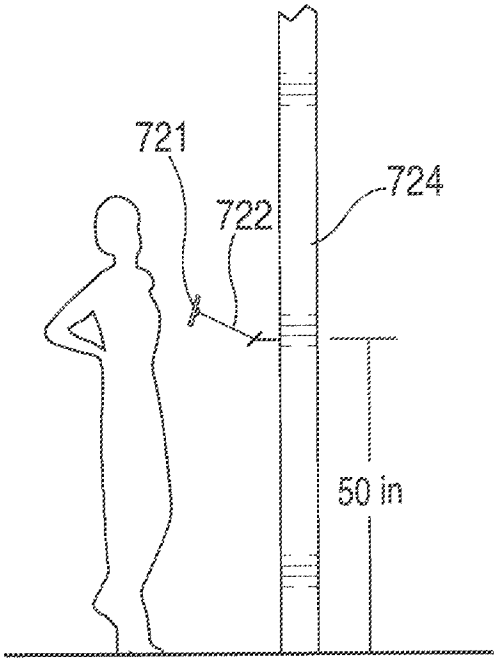
FIGS. 7A-7C and 8A-8C are diagrams of handheld device securing systems coupled to a base, in accordance with some embodiments of the invention.
Figure 7B:
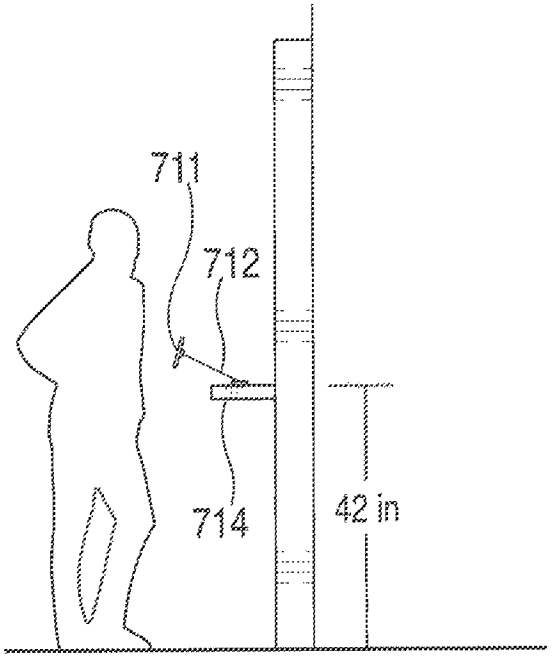
Figure 7A:
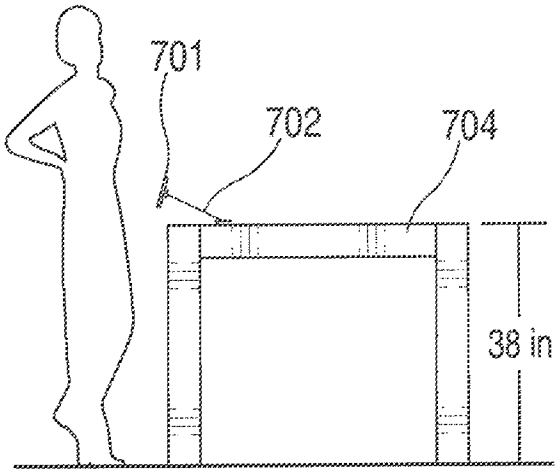

FIGS. 7A-7C and 8A-8C are diagrams of handheld electronic device securing systems connected to a fixture, in accordance with some embodiments of the invention. As shown in FIGS. 7A-7C, respectively, for example, cables 702, 712, and 722 may be positioned in a non- or slightly extended state. This can correspond to a typical position that may be used to present or display devices to a consumer. In some embodiments, the particular length of each cable can be the same or different based on a type of fixture to which the cable is connected. For example, as shown in FIG. 7A, cable 702 can be coupled to a device 701 and to a table 704. As shown in FIG. 7B, cable 712 can be coupled to a device 711 and to a counter 714. As shown in FIG. 7C, cable 722 can be coupled to a device 721 and to a wall 724. In some embodiments, the lengths of cables 702, 712, and 722 can be selected based on the type of device it is coupled to (e.g., whether or not the device is to be placed near a user's head). As shown in FIGS. 7A-7C, for example, devices 701, 711, and 721 may not need to be positioned near a user's head, but rather may only need to be held in a user's hands. Therefore, in such embodiments, the length of a cable may be in the range of about 10 inches to 14 inches.

Figure 8C:
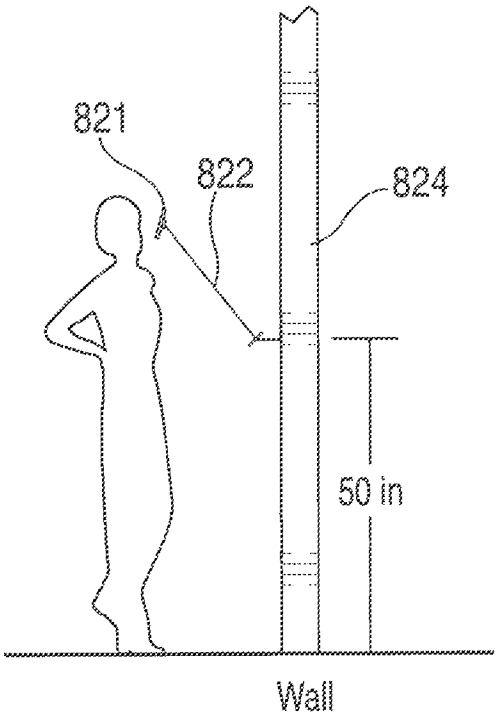
Figure 8B:
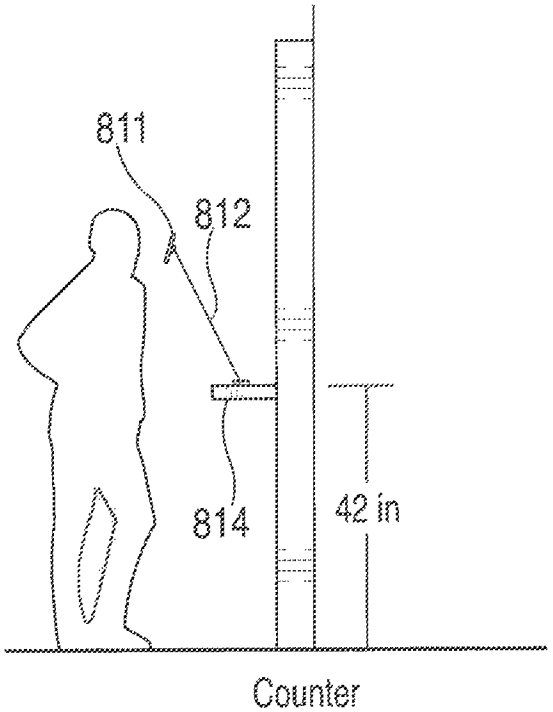
Figure 8A:
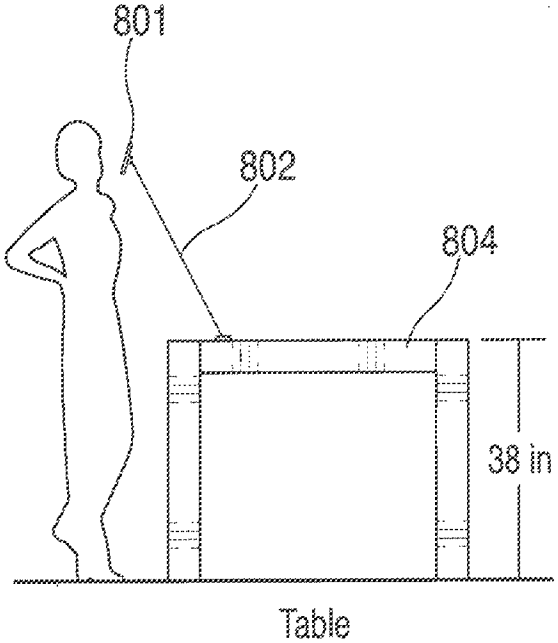

In FIGS. 8A-8C, cables 802, 812, and 822 may be positioned in an extended state. This is typically the position that allows a consumer to freely use and hold the device. For example, in the case of a telephone device, the distance of the extended state may allow the user to place the device near or next to their ear. Therefore, in such embodiments, the length of a cable may be in the range of about 36 inches to 40 inches. In some embodiments, the particular length of each cable can be the same or different based on a type of fixture to which the cable is connected. For example, as shown in FIG. 8A, cable 802 can be coupled to a device 801 and to a table 804. As shown in FIG. 5B, cable 812 can be coupled to a device 811 and to a counter 814. As shown in FIG. 8C, cable 822 can be coupled to a device 821 and to a wall 824.

Figure 9B:
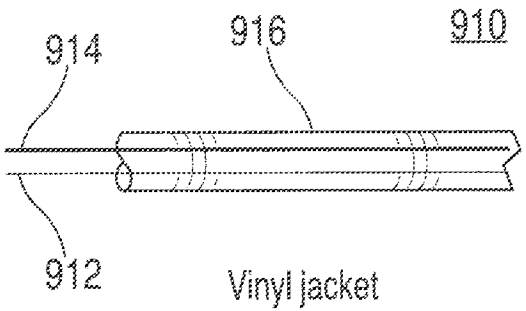
FIGS. 9A-9C are diagrams of a cable of a handheld electronic device security system, in accordance with some embodiments of the invention.
Figure 9C:
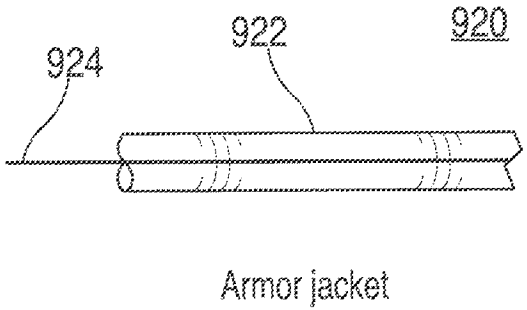
Figure 9A:
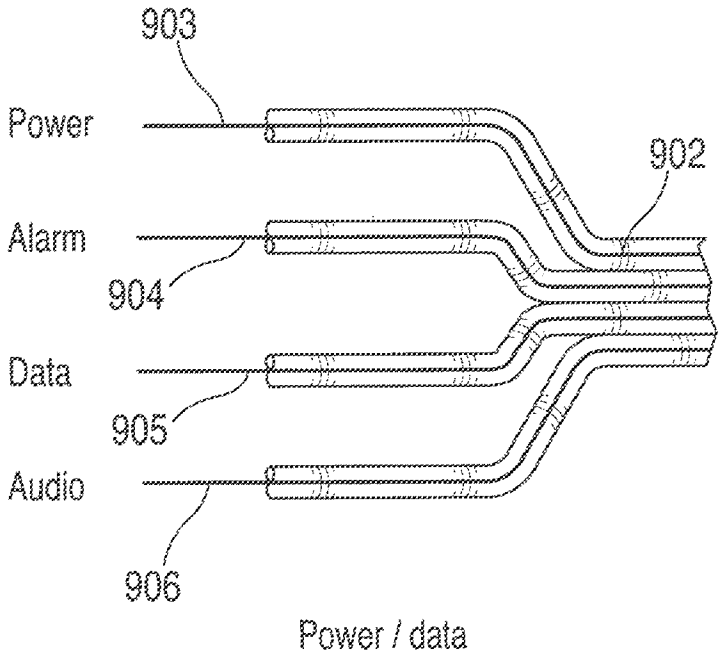

FIGS. 9A-9C are diagrams of cable types of a handheld device security system, in accordance with several embodiments of the invention. In some embodiments, as shown in FIG. 9A, for example, a cable 902 may integrate security features with data, power, and other signal paths (e.g., audio) that may be used to communicate signals with a handheld electronic device. For example, cable 902 can include a power path 903, an alarm path 904, a data path 905, and an audio path 906. Alarm path 904 may serve to monitor for cuts or a decoupling of cable 902, and may be used to drive an alarm. When alarm path 904 is adversely affected (e.g., cut into or decoupled), an alarm may be sounded at the device, an associated stand, docking station, fixture, and/or the like. Alarm path 904 may be a dedicated path or it may also be a data, power, and/or audio path that may also act as an alarm path.

Cable 902, however, may not include any feature for preventing cable 902 from being cut (e.g., cable 902 may not include any physical security element). To remedy this, a cable can include a physical security element. In some embodiments, as shown in FIG. 9B, for example, a security element 912 can be enclosed by an outer sheath 916 (e.g., vinyl) of a cable 910 with an alarm path 914. That is, security element 912 may include a wire that can extend through cable 910 along with any power/data lines of cable 910. Such a wire may be configured to resist cutting or any other type of separation or decoupling. It should be appreciated that the physical security element and electrical security element may be a single element. In other embodiments, as shown in FIG. 9C, for example, a security element 922 may be a sheath itself of a cable 920, in which an alarm path 924 may be enclosed. This type of configuration may be referred to as an armor jacket. The material selected for the armor jacket may be configured to resist cutting or any other type of separation or decoupling.

Figure 10B:
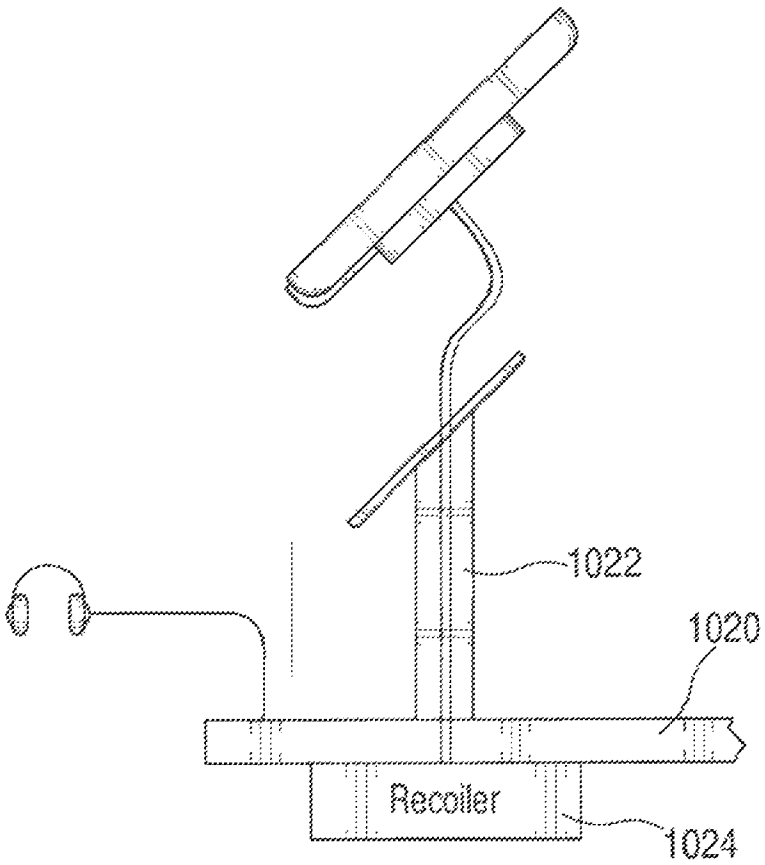
FIGS. 10A and 10B are diagrams of a handheld electronic device security system, in accordance with some embodiments of the invention.
Figure 10A:
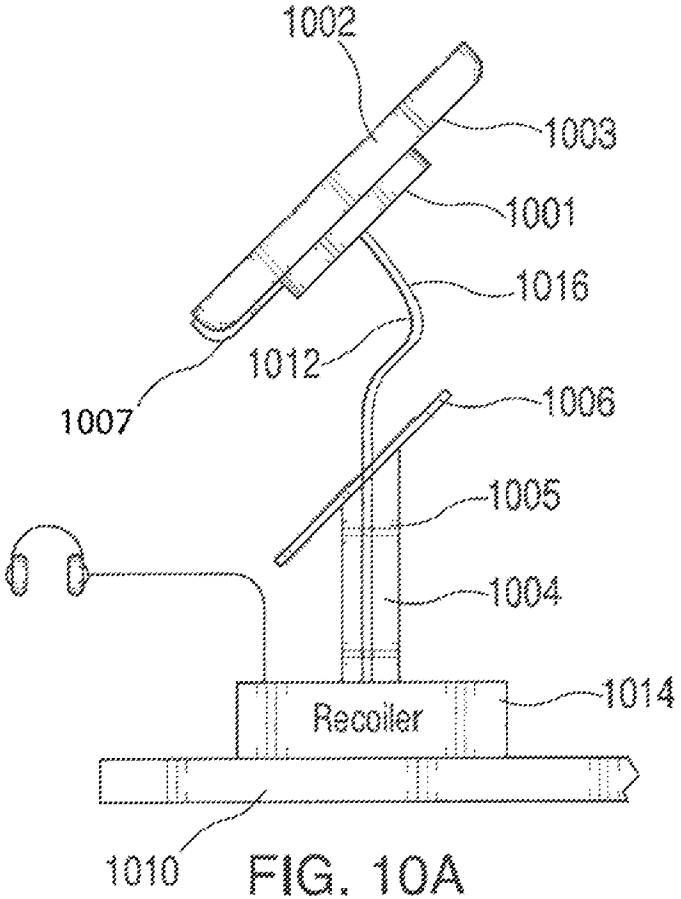

FIGS. 10A and 10B are diagrams of a handheld electronic device security system in accordance with some embodiments of the invention. The handheld electronic device security system may be configured to secure a handheld electronic device to a fixture using a stand. The stand may provide a surface onto which the handheld device may rest. In some embodiments, as shown in FIG. 10A, for example, a device 1002 can be placed on a stand 1004 that may include a platform 1006 for receiving a back side 1003 of electronic device 1002 and a post 1005 for maintaining platform 1006 offset from a surface of a fixture 1010 to which stand 1004 may be coupled. Stand 1004 can be attached to fixture 1010 such that it may not be movable therefrom (e.g., fixed). For example, stand 1004 may be glued, fastened, or otherwise attached to fixture 1010. In some cases, stand 1004 may even be integral with fixture 1010. Although the example of FIG. 10A includes stand 1010 for supporting device 1002, it should be appreciated that other configurations can be used to support device 1002 (e.g., a docking station).

In accordance with some embodiments, the handheld electronic device security system may further include a cabling system 1012 for movably coupling handheld electronic device 1002 to stand 1004. Cabling system 1012 may allow handheld device 1002 to move relative to stand 1004 while keeping it secured thereto. Cabling system 1012 can include a cable 1016 attached at one end to handheld electronic device 1002, and to stand 1004 at another end. As such, handheld electronic device 1002 may be retained to fixture 1010 via stand 1004. Although retained, cable 1016 can allow handheld electronic device 1002 to be extended away from stand 1004 so that a user can freely hold and/or use handheld electronic device 1002. In some cases, stand 1004 may include a throughhole for allowing cable 1016 to pass therethrough. The throughhole may, for example, extend through platform 1006 and post 1005 of stand 1004.

Although a variety of techniques can be used to provide the extending capabilities of cable 1016, as shown in FIG. 10A, the handheld electronic device security system may further include a recoiler 1014. Recoiler 1014 may be configured as a portion of stand 1004 or it may be a separate element that works with stand 1004. For example, recoiler 1014 can be placed on the same surface of fixture 1010 as stand 1004. Alternatively, as shown in FIG. 10B, a recoiler 1024 can be placed on an opposite surface of a fixture 1020 as a stand 1022. In either case, recoiler 1014 may be configured to continuously bias cable 1016 in a non-extended position relative to stand 1004, which may keep cable 1016 taut when device 1002 is placed on stand 1004 (e.g., with no or minimal amounts of slack). Recoiler 1014 may also allow cable 1016 to be roiled out or extended against the recoil force. The recoil force may, for example, be provided via a spring action. In some cases, the recoil force may only be designed to reduce slack, which may make it easy to extend.

In some embodiments, cable 1016 can be attached to handheld electronic device 1002 via a coupler 1001. Coupler 1001 may be attached, for example, to backside 1003 of device 1002. Coupler 1001 may be attached using a wide variety of techniques including, for example, fasteners, glues, locks, and other attachment agents such that coupler 1001 may be fixed to device 1002. In some embodiments, coupler 1001 may interface with stand 1004. For example, as coupler 1001 may protrude away from device 1002, a mating feature may be provided in platform 1006 of the stand 1004 to receive at least a portion of coupler 1001.

In accordance with some embodiments, a cable may be both an electric cable and a security cable. For example, as described above in connection with FIGS. 9A-9C, a cable may integrate security and electrical functionality (e.g., data/power, audio, alarm, etc.). As such, the cable and/or a coupler may include a connector (see, e.g., connector 1007 of FIG. 10A, which may be a 30-pin connector or any other suitable connector) that may interface with a corresponding connector of a handheld electronic device. The connector may provide a path by which data, instructions, or other information can be retrieved from or transferred to the electronic device. In one example, a physical security element of a cable may be attached to a coupler while the electrical elements of the cable may be attached to a connector that may couple with the electronic device. Alternatively, a physical security element of a cable may in addition be securely coupled to a connector of an electronic device. In some cases, a coupler may additionally include an alarm that can sound when a portion or all of the cable is severed or decoupled from the coupler.

Figure 11:
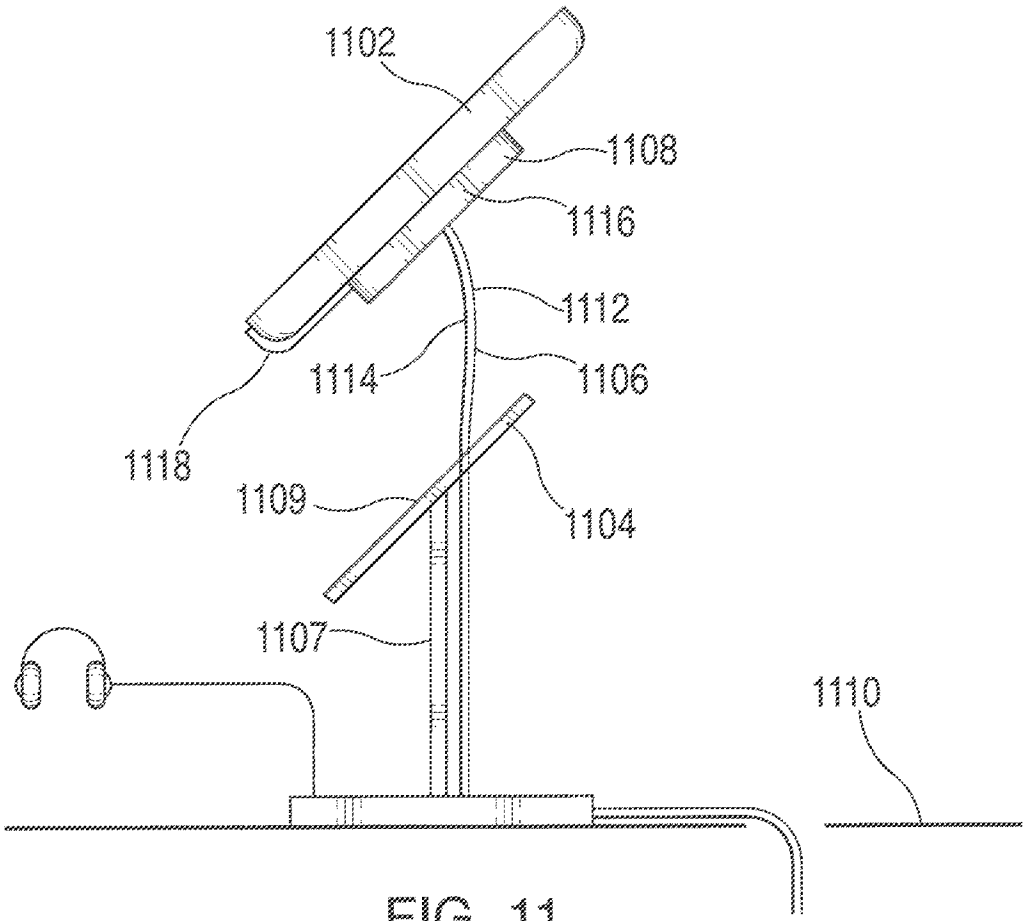
FIG. 11 is a diagram of a handheld electronic device security system, in accordance with some embodiments of the invention.

FIG. 11 is a diagram of a handheld electronic device security system in accordance with some embodiments of the invention. The system of FIG. 11 may be similar to the systems shown in FIGS. 10A and 10B. In the system of FIG. 11, an electronic device 1102 can be secured to a fixture 1110 by a cable 1106. To present electronic device 1102 in a pleasing manner, the system can include a stand 1104 for supporting electronic device 1102. A first end of cable 1106 can be secured to electronic device 1102 via a coupler 1108, which can include some or all of the features of the couplers described above. Another end of cable 1106 can be secured to one or both of stand 1104 and fixture 1110. Cable 1106 can be provided with stand 1104 using any suitable approach. In some cases, cable 1106 can pass through a post of stand 1104, as shown in the embodiments of FIGS. 10A and 10B. Alternatively, as shown in FIG. 11, cable 1106 can pass next to a post 1107, and through a platform 1109 of stand 1104. In some cases, portions of cable 1106 can pass through fixture 1110 and to a host device or a power supply located underneath or behind fixture 1110.

Figure 12:
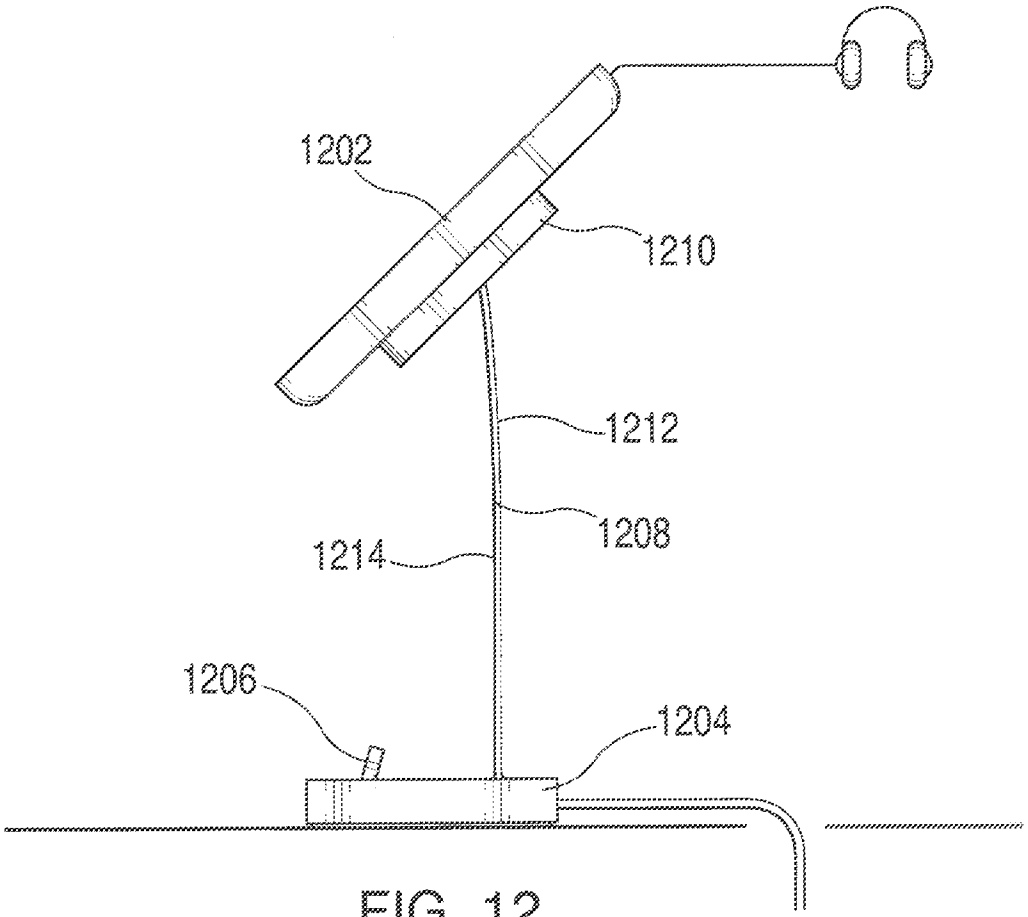
FIG. 12 is a diagram of a handheld electronic device security system, in accordance with some embodiments of the invention.

To provide security for electronic device 1102, cable 1106 can include at least electric path 1112 for transferring data, power, alarm, or several of these signals, and a security cable 1114. An alarm 1116 can be provided near electronic device 1102, for example, as part of coupler 1108. To further secure coupler 1108 to electronic device 1102 while providing data to device 1102, the system can include a connector 1118 that may mate with a corresponding connector of electronic device 1102. For example, connector 1118 can include a 30-pin connector incorporated in a plastic tab extending from coupler 1108 for coupling with a respective 30-pin connector of device 1102, FIG. 12 is a diagram of a handheld electronic device security system in accordance with some embodiments of the invention. Like the system shown in FIG. 11, this system may include an integrated cable/coupler. But instead of a stand as in FIG. 11, the system of FIG. 12, may include a docking station 1204 having a connector 1206 for interfacing with a connector of an electronic device 1202. A cable 1208, which can include an electric path 1212 and a security cable 1214, can couple electronic device 1202 to docking station 1204, to a host device, to a power supply, or to combinations of these. In some cases, cable 1208 can be coupled to electronic device 1202 via a coupler 1210, which can include an alarm.

Figure 13:
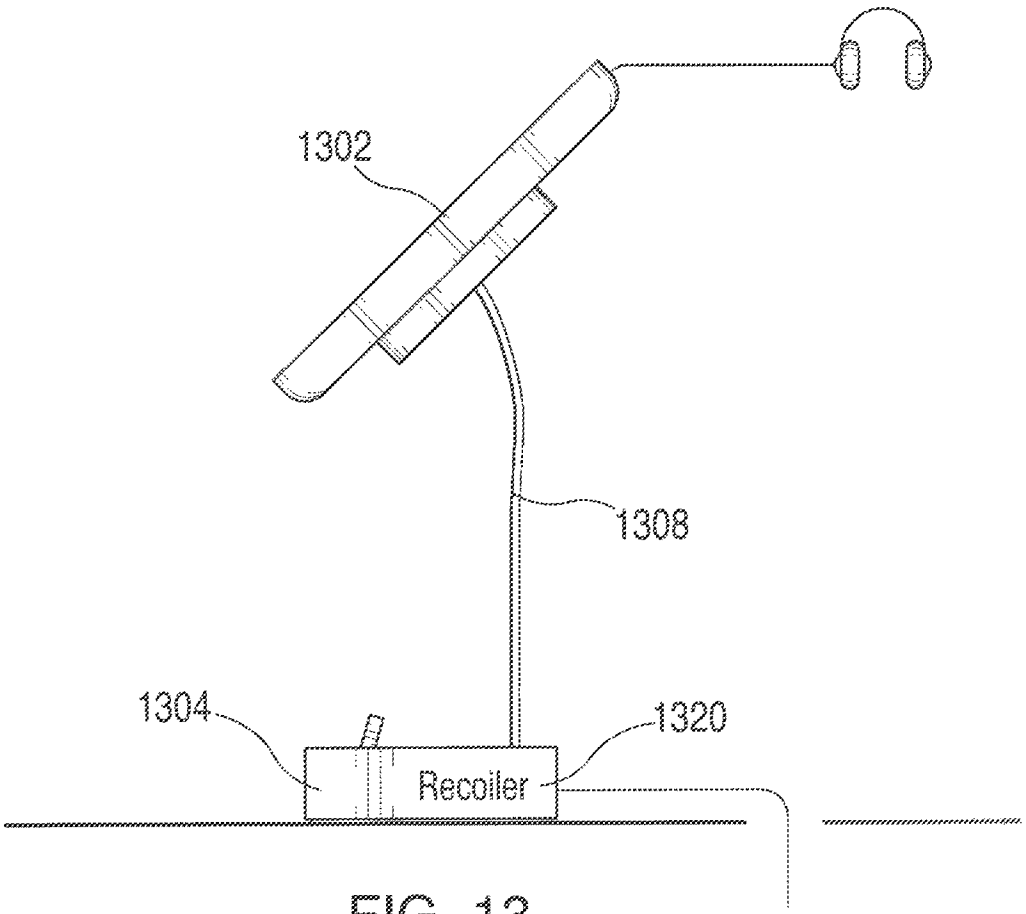
FIG. 13 is a diagram of a handheld electronic device security system, in accordance with some embodiments of the invention.

FIG. 13 is a diagram of a handheld electronic device security system in accordance with some embodiments of the invention. This embodiment may be similar to the one shown in FIG. 12 except that the system of FIG. 13 may additionally include a recoiler 1320 that may bias arable 1308 that may connect an electronic device 1302 to a docking station 1304 in a non-extended state. Recoiler 1320 may be enclosed within docking station 1304 or alternatively may be outside of docking station 1304. Each component of the system of FIG. 13 can include some or all of the features of systems described above (e.g., features described in connection with FIGS. 11 and/or 12).

FIGS. 14A-14D are diagrams of respective couplers 1404, 1414, 1424, and 1434 of a handheld electronic device security system, in accordance with some embodiments of the invention. Each of couplers 1404, 1414, 1424, and 1434 may be used to attach a respective cable 1406. 1416, 1426, and 1436 to a respective electronic device 1402, 1412, 1422, and 1432. By way of example, as shown, each coupler may be used to attach a cable to a music player electronic device and/or cellular telephone, such as any of those manufactured by Apple Inc. of Cupertino Calif. (e.g., iPod nano™ 1402, iPod classic™ 1412, iPod Touch™ 1422, and iPhone™ 1434).

Figure 14B:
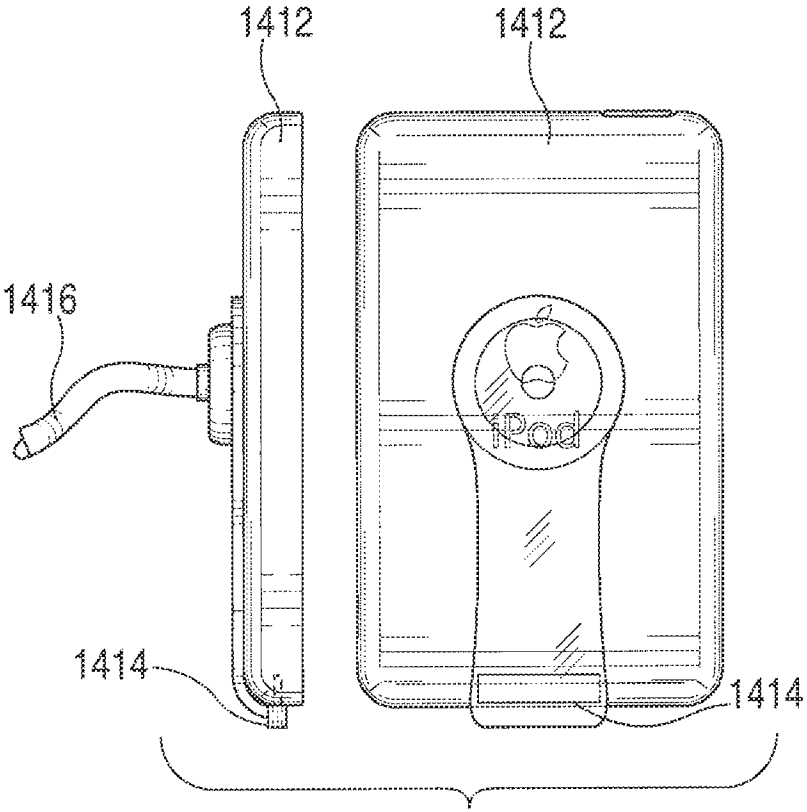
FIGS. 14A-14D are diagrams of an attachment fixture of a handheld electronic device security system, in accordance with some embodiments of the invention.
Figure 14A:
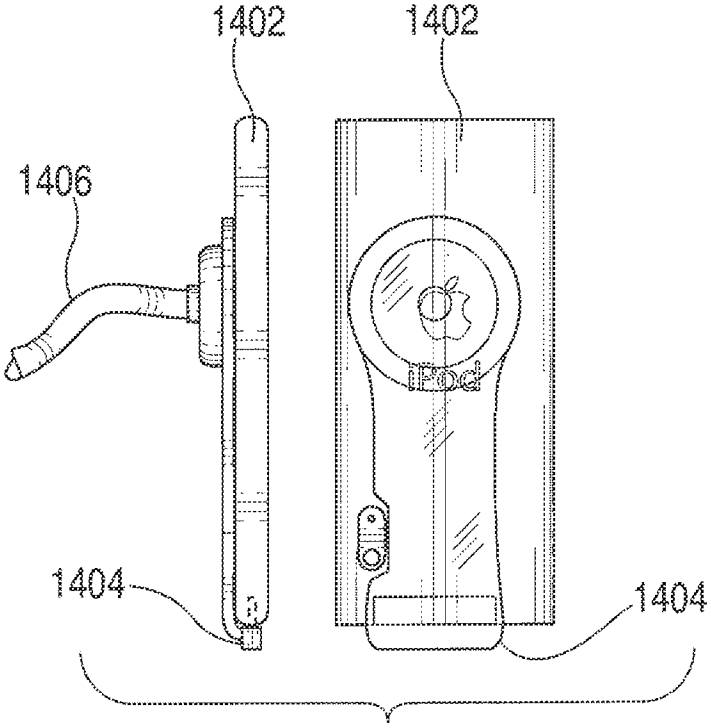
Figure 14D:
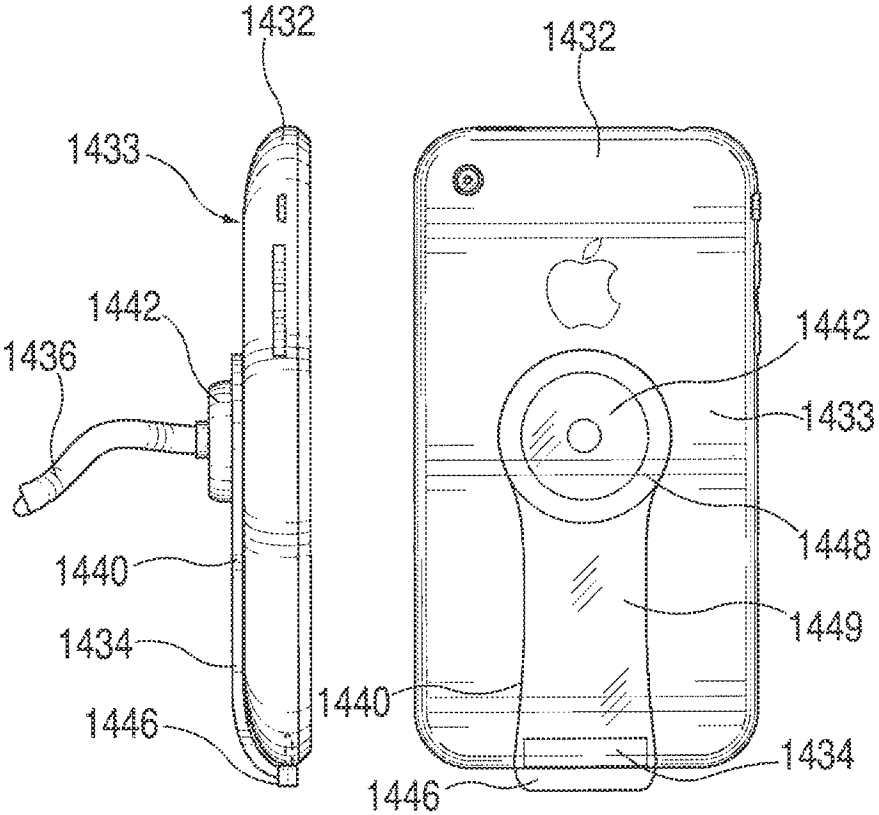
Figure 14C:
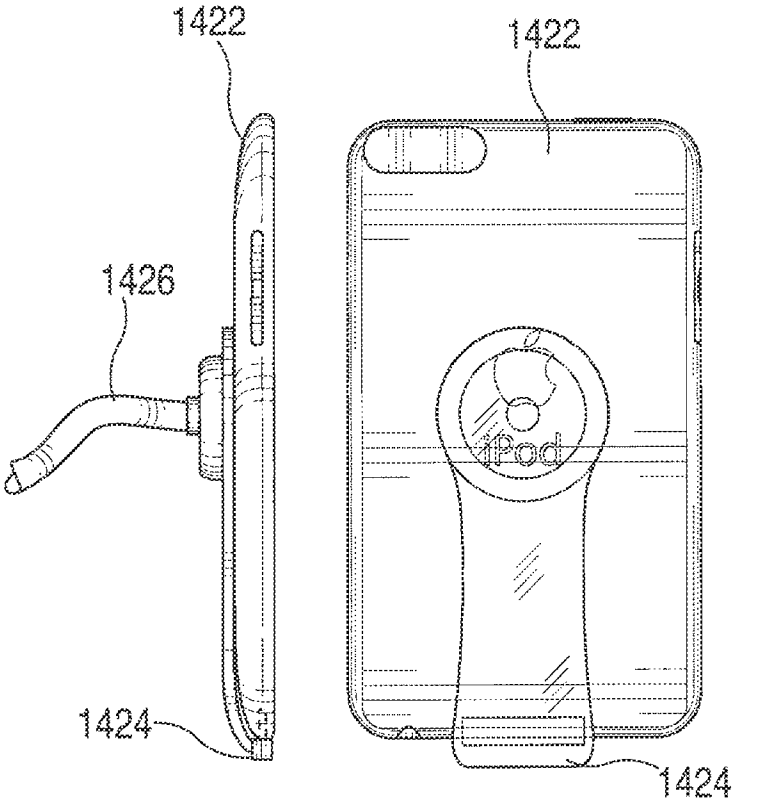

Although the following discussion will describe the system of FIG. 14D, it will be understood that it may be applied to any of the couplers described herein, and in particular to any of the couplers shown in FIGS. 14A-14C. Coupler 1434 may include a body 1440 that may interface with a surface 1433 of handheld electronic device 1432 (e.g., a back surface or surface opposite the main user interface of device 1432). Body 1440 may provide one or more attachment points or areas for fixing coupler 1434 to handheld electronic device 1432. The attachment may be accomplished using any suitable approach including, for example, with fasteners, glue, or adhesives. In some cases, body 1440 can include one or more features for clipping to a portion of electronic device 1432 (e.g., an upper tab or side tabs, not shown).

Coupler 1434 may also include a terminal 1442 that may interface with a stand in order to present handheld electronic device 1432 to the potential consumer. Terminal 1442 may, for example, engage a feature on a stand in order to detachably secure or hold handheld electronic device 1432 relative to the stand. Terminal 1442 may include, for example, one or more snaps, detents, grooves, guides, channels, latches, protrusions or chamfers.

In some cases, coupler 1434 may also include a connector 1446 that may interface with a corresponding connector of handheld electronic device 1432. Connector 1446 can be connected to cable 1436, either directly (e.g., via soldering) or through an intermediate component (e.g., through an electronic interface or carrier between cable 1436 and connector 1446). For example, body 1440 may include a printed circuit board, a flex circuit, or a rigid flex that can provide traces or interconnects between cable 1436 and connector 1446. The electronic interface or carrier may provide additional functionality to coupler 1434 including, for example, alarm components.

The shape of body 1440 may be widely varied. In some cases, body 1440 may be a compliant or flexible element such that it may conform to the shape of device 1432 when secured thereto. In other cases, body 1440 may be a rigid member that may substantially follow the contour of device 1432. Alternatively, body 1440 may include both rigid and flexible portions. For example, body 1440 may include a rigid section 1448 for physical attachment to device 1432 and a flexible portion 1449 for detachably securing connector 1446 to the connector of device 1432. In some embodiments, body 1440 may be a somewhat rigid member that may fit the shape of device 1432, such that body 1440 may be slid onto device 1432 (e.g., such that the connectors of the body and the device may engage). Thereafter, body 1440 may be attached to device 1432.

The placement of terminal 1442 on body 1440 may be widely varied. As shown, terminal 1442 may be somewhat aligned with the center of back surface 1433 of electronic device 1432. Alternatively, terminal 1442 can be positioned relative to a center of gravity of electronic device 1432 to ensure that electronic device 1432 may be properly supported by a stand.

Figure 15:
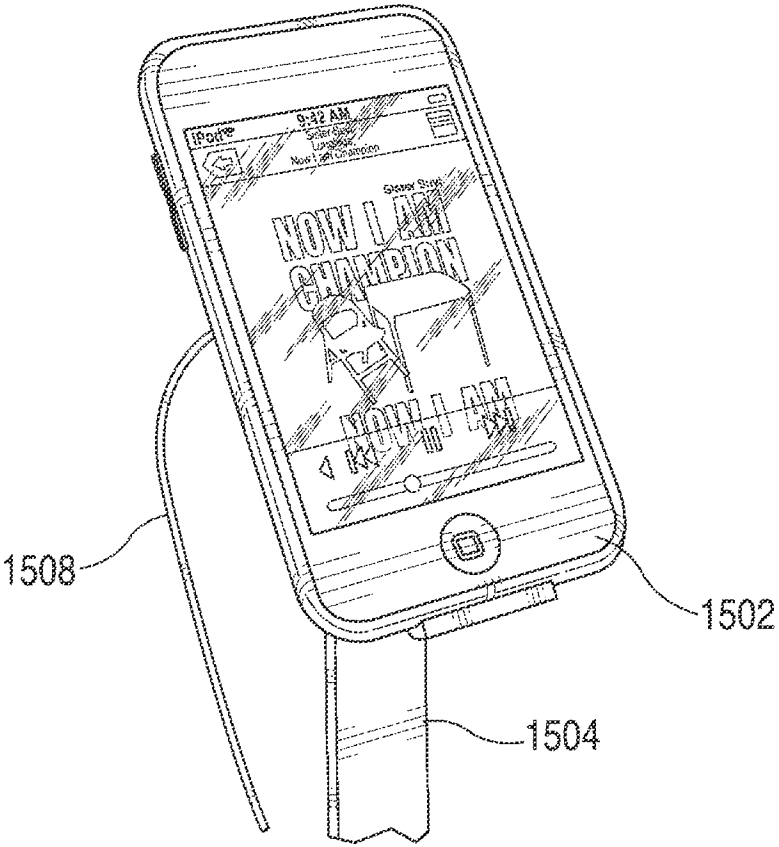
FIG. 15 is a diagram of a handheld electronic device security system, in accordance with some embodiments of the invention.
Figure 16:
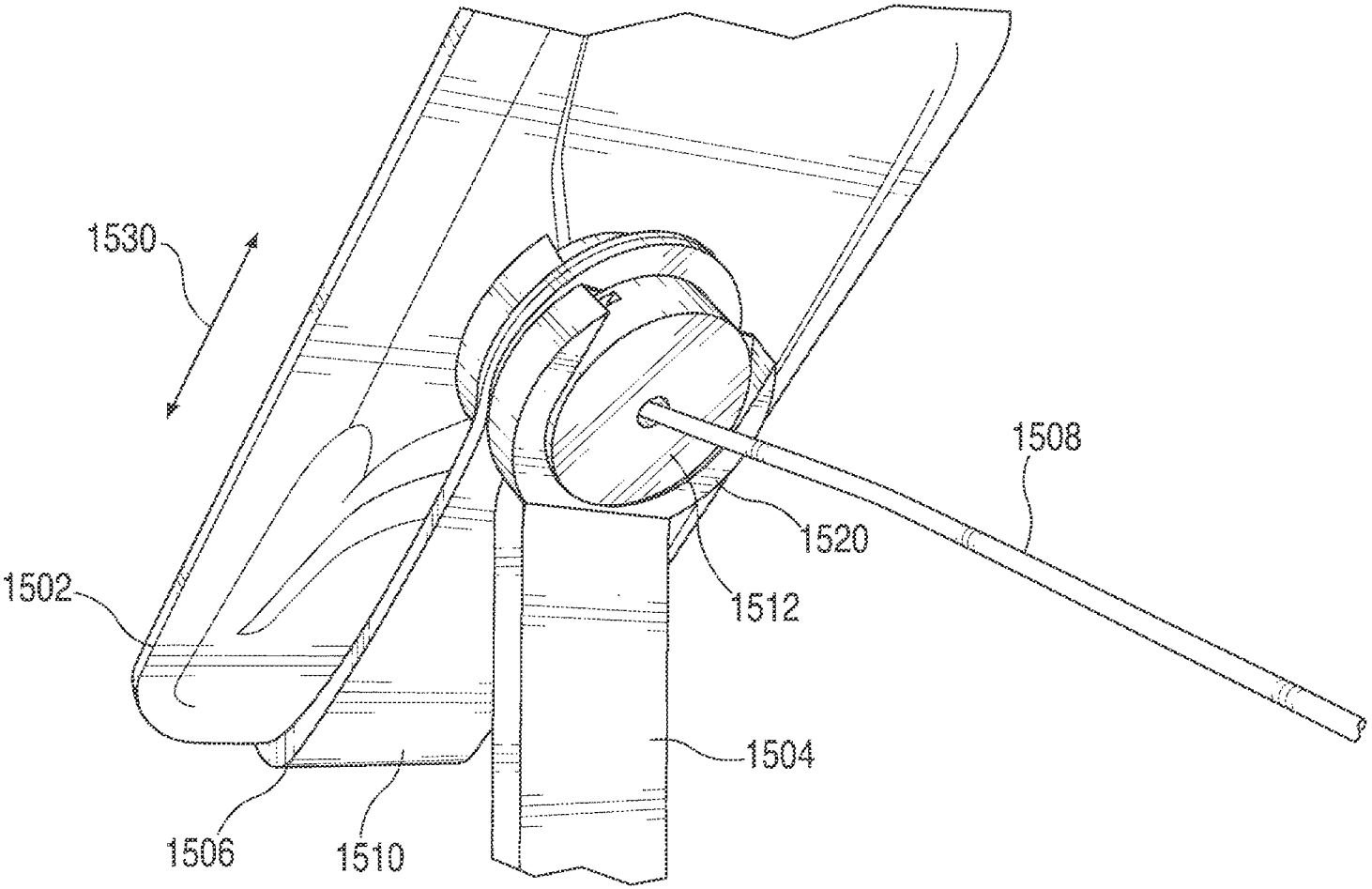
FIG. 16 is a diagram of an attachment system of a handheld electronic device security system, in accordance with some embodiments of the invention.
Figure 17:
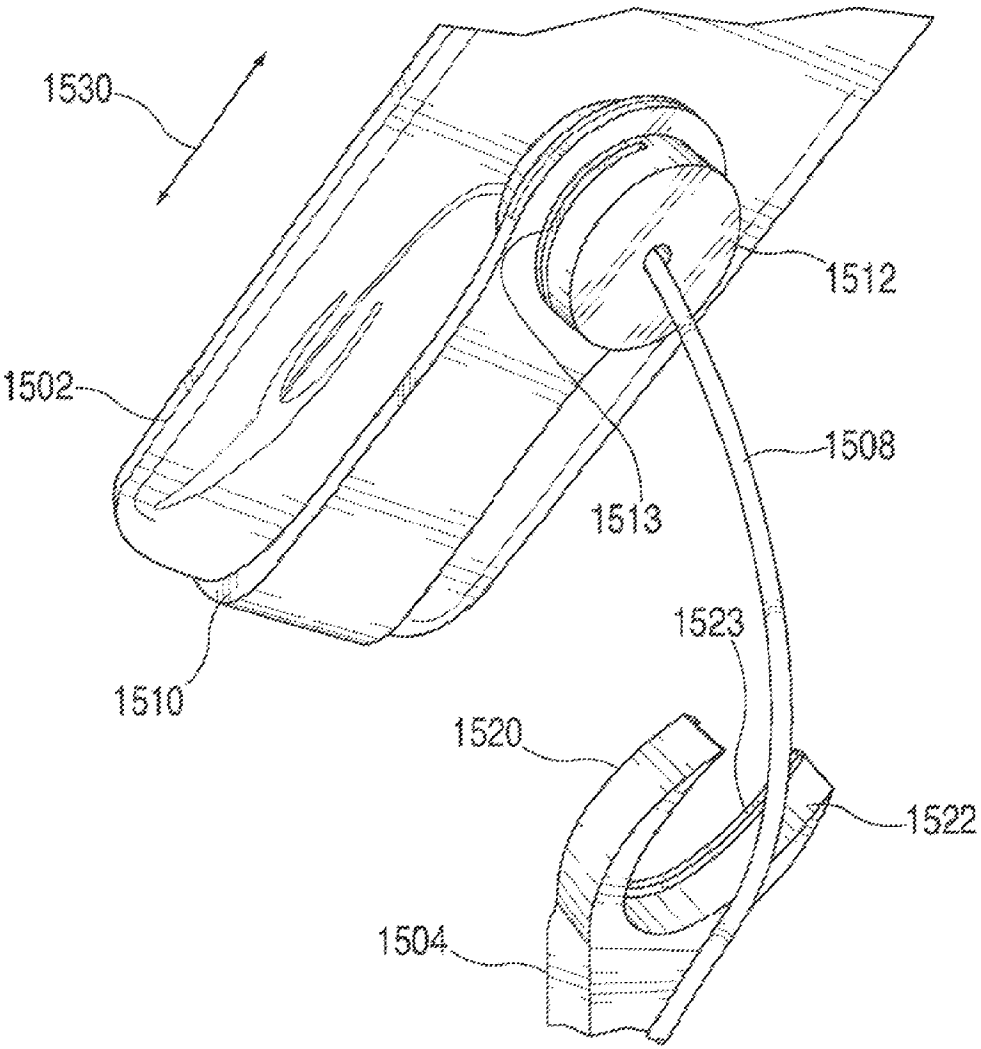
FIG. 17 is a diagram of an attachment system of a handheld electronic device security system, in accordance with some embodiments of the invention.

FIGS. 15-17 are diagrams of a handheld electronic device security system in accordance with some embodiments of the invention. As shown, the system may include a coupler 1506 that may attach to a handheld electronic device 1502 and a stand 1504 that may hold device 1502 in a position for presenting device 1502 to a potential consumer. Stand 1504 and coupler 1506 can include some or all of the features of the corresponding components described above. The system can include a cable 1508 that may secure coupler 1506, and thus electronic device 1502, to a fixture.

To expose electronic device 1502, coupler 1506 can include a terminal 1512 that may extend from a body 1510 of coupler 1506. As shown in FIG. 17, for example, terminal 1512 can be received by a slot 1522 in a platform 1520 of stand 1504. The size and shape of slot 1522 can be selected to correspond to the shape and dimensions of terminal 1512, such that electronic device 1502 may be retained by stand 1504. Platform 1520 of stand 1504 may be designed to place device 1502 at the desired orientation relative to a consumer.

In some embodiments, terminal 1512 can include a protruding member that may physically interface with slot 1522 built into platform 1520. The protruding member may, for example, be formed as a cylinder and slot 1522 may be U-shaped with a curvature similar to that of the cylinder. For example, in some embodiments, terminal 1512 may further include a groove 1513 that can engage a flange 1523 on platform 1520. In order to engage device 1502 with platform 1520, a consumer may slide device 1502 on or of platform 1520 via the engagement of terminal 1512 and groove 1513 with slot 1522 and flange 1523 in the direction of arrow 1530. Flange 1523 and groove 1513 may help prevent rotation of device 1502 relative to platform 1520.

Figure 18:
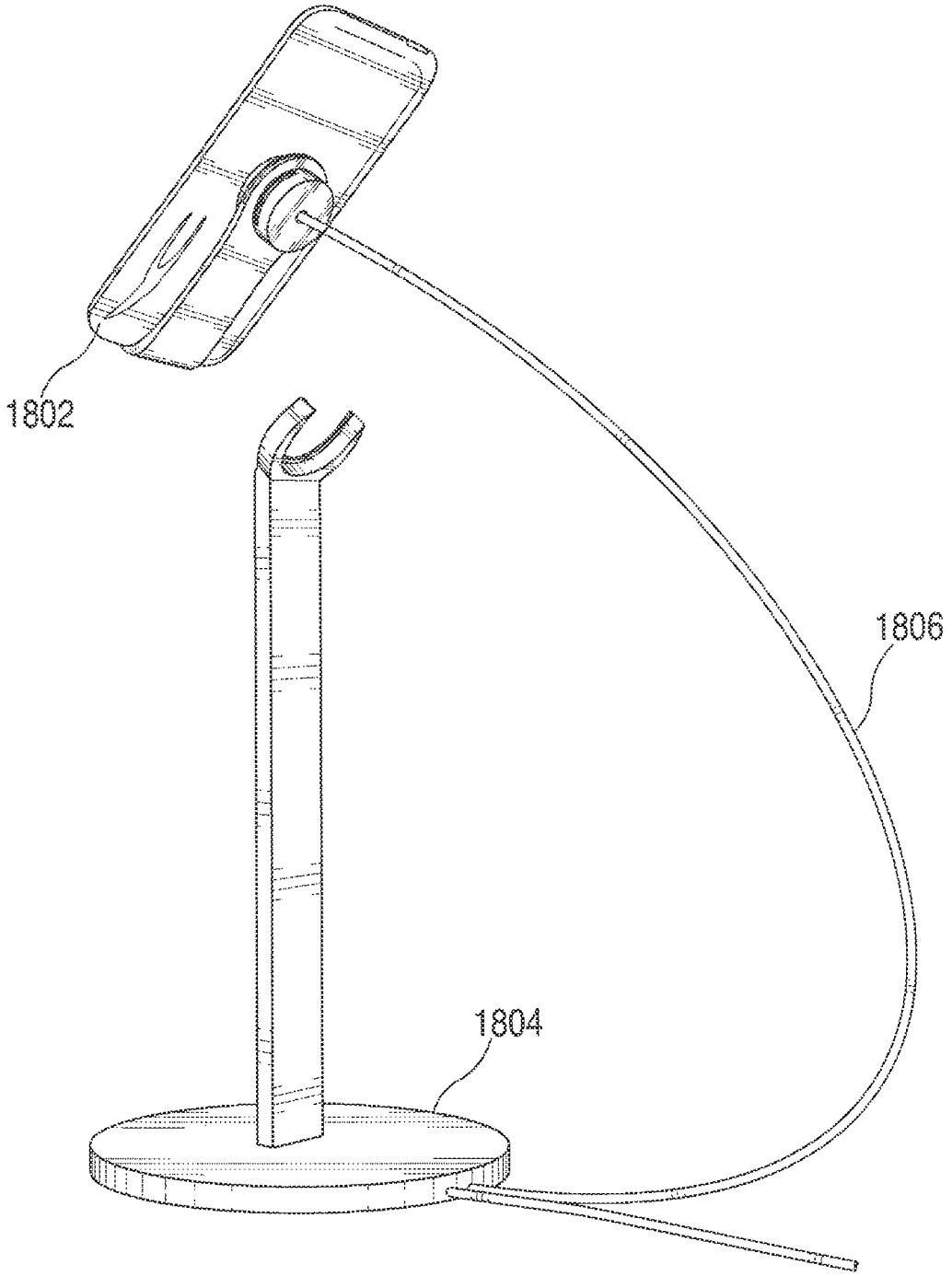
FIG. 18 is a diagram of a handheld electronic device security system, in accordance with some embodiments of the invention.
Figure 19:
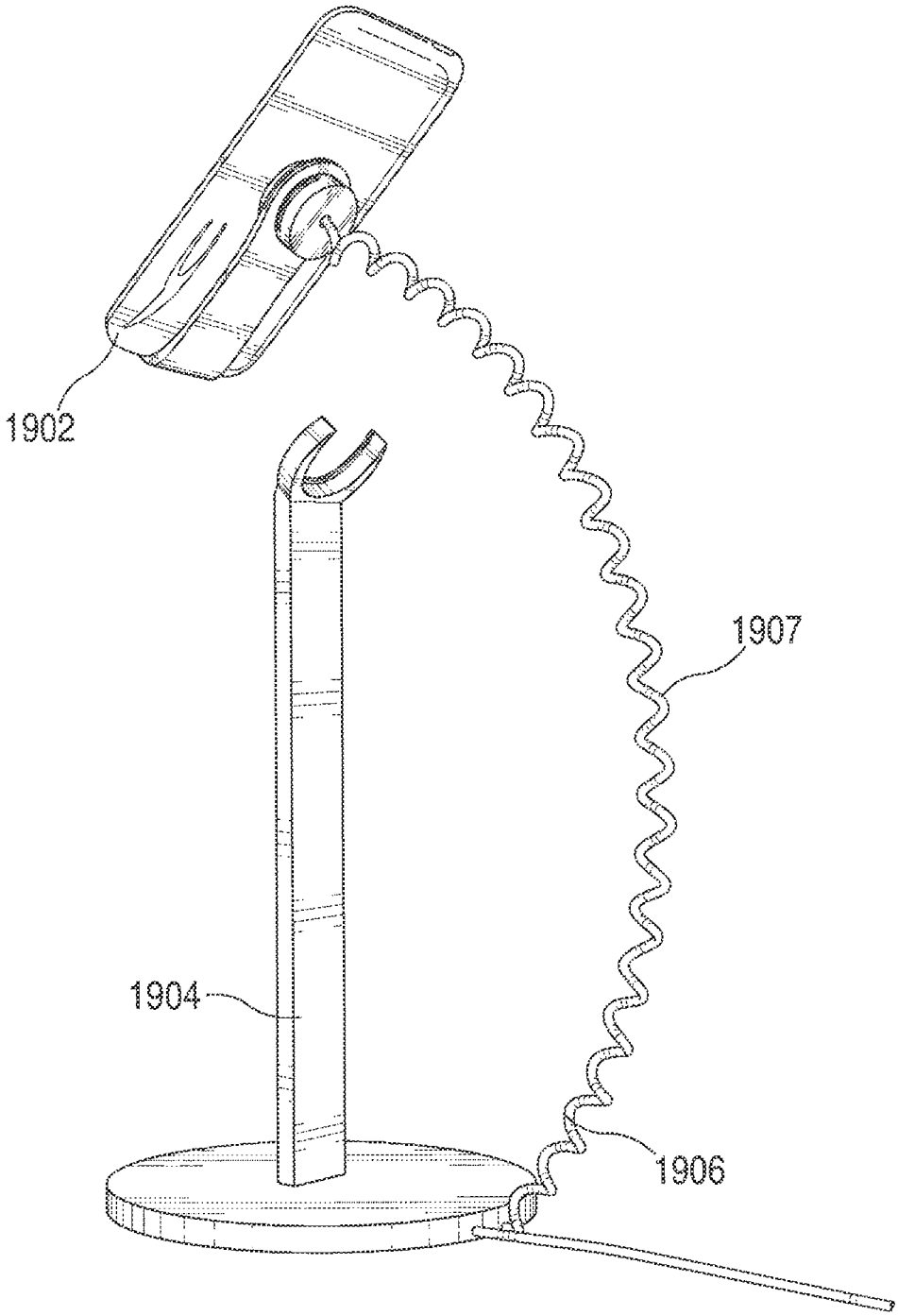
FIG. 19 is a diagram of a handheld electronic device security system, in accordance with some embodiments of the invention.
Figure 20:
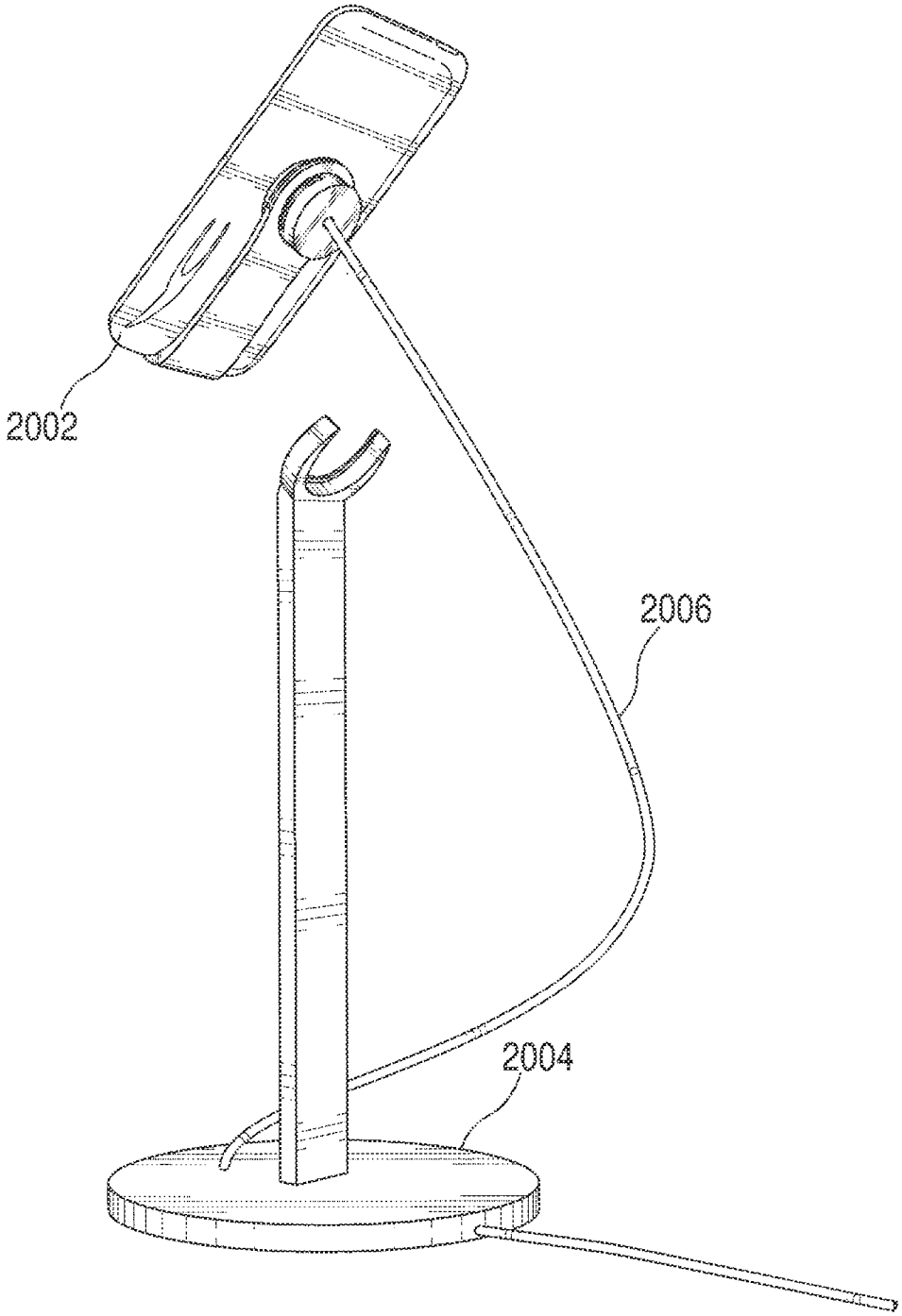
FIG. 20 is a diagram of a handheld electronic device security system, in accordance with some embodiments of the invention.
Figure 21:
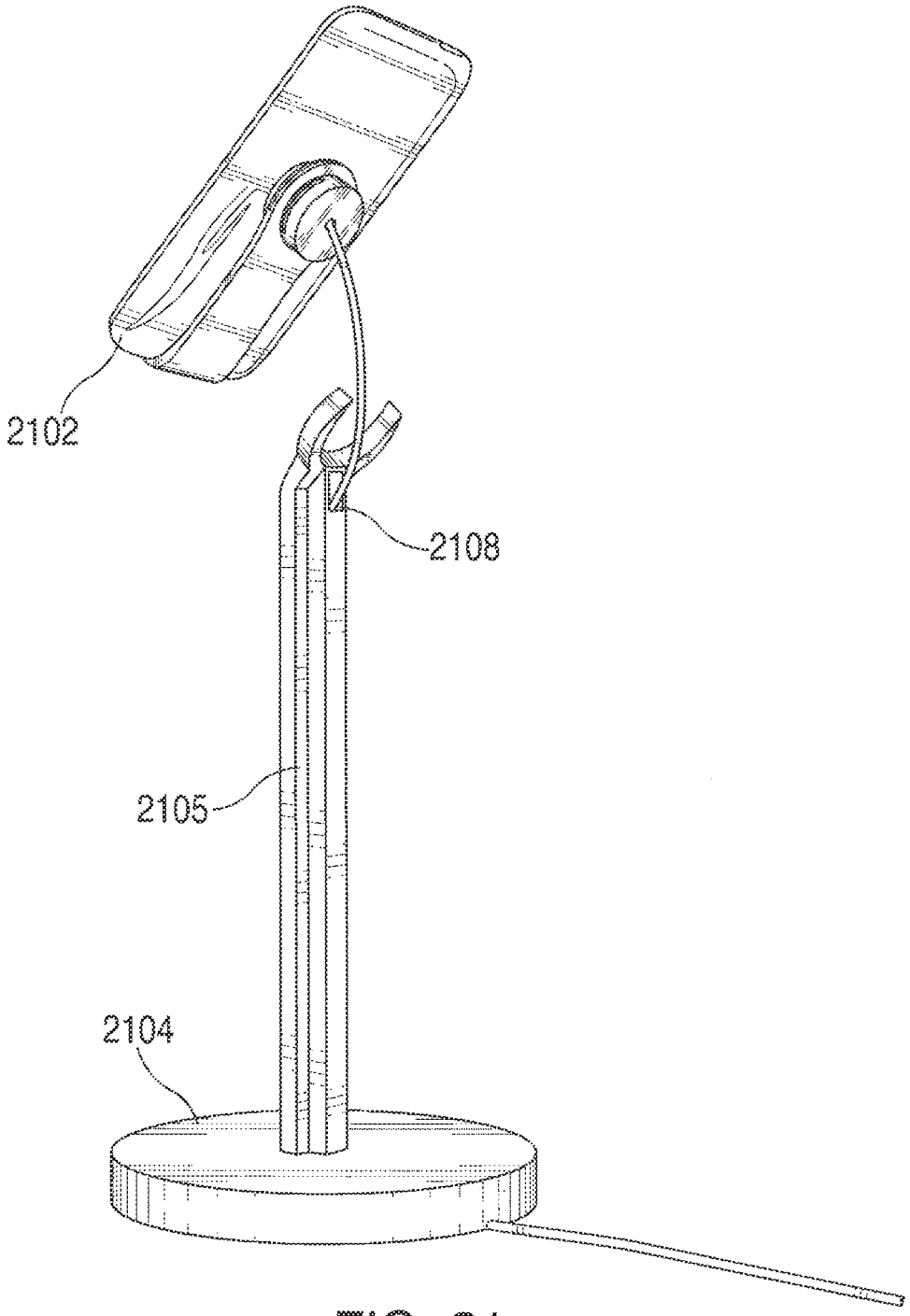
FIG. 21 shows an embodiment of a handheld electronic device security system.

FIGS. 18-21 show various embodiments of a handheld electronic device security system, similar to that shown in FIGS. 15-17, but in which a cable has one or more different configurations. As shown in FIG. 18, for example, a cable 1806 may be attached to the base of a stand 1804. Cable 1806 may be attached behind a post of stand 1804. Furthermore, cable 1806 may be provided with enough slack to allow a consumer to use or hold a device 1802 coupled to cable 1806. In some embodiments, as shown in FIG. 19, for example, a cable 1906 coupled to a device 1902 may include one or more coils 1907, and cable 1906 may also be coupled to a base of a stand 1904 and behind a post of stand 1904. In some embodiments, as shown in FIG. 20, for example, a cable 2006 may be attached to a device 2002 and to a base of a stand 2004 in front of a post of stand 2004. In some embodiments, as shown in FIG. 21, for example, a cable 2106 coupled to a device 2102 may be provided through a post 2105 of a stand 2104. Post 2105 may include an opening 2108 near an end of post 2105 that may be adjacent to electronic device 2102, such that cable 2106 may be somewhat hidden from the view of a user of device 2102.

Examples of electronic devices that can be used with the security systems described herein may include, but are not limited to, media players that play or otherwise transmit audio and/or visual (e.g., video or picture) signals (e.g., an iPod™ by Apple Inc.) and cellular telephones or other devices that allow users to communicate remotely through wireless connections. Electronic devices may also correspond to mini-computers, tablet computers, PDAs, internet or e-mail based devices, or any other handheld or portable electronic device. Some electronic devices may be a combination of specific or dedicated devices mentioned above (e.g., an iPhone™ or an iPad™ by Apple Inc.).

Insubstantial changes from the claimed subject matter as viewed by a person with ordinary skill in the art, now known or later devised, are expressly contemplated as being equivalently within the scope of the claims. Therefore, obvious substitutions, alterations, permutations, and equivalents, now or later known to one with ordinary skill in the art, are defined to be within the scope of the defined elements.

The above described embodiments of the disclosed systems and methods are presented for purposes of illustration and not of limitation. Further, it should be noted that the language used in the specification has been principally selected for readability and instructional purposes, and may not have been selected to delineate or circumscribe the disclosed subject matter. Accordingly, the disclosure of the presently disclosed subject matter is intended to be illustrative, but not limiting, of the scope of the claimed subject matter, which is set forth in the following claims.

What is claimed is:

1. A security system for a handheld electronic device, the system comprising:

a coupler comprising a body and a terminal that protrudes from the body, wherein the body comprises tabs for attaching to a device, wherein the tabs are disposed at sides of the body, wherein each tab is configured to grip, between itself and the body, a portion of the device, and wherein the tabs are configured to prevent the device from moving relative to the body in any direction;

a stand comprising a post having an upper end, a lower end, and a through-hole from the upper end to the lower end, wherein an upper end of the post defines a recess for receiving at least a portion of the terminal; and a cable extending from the terminal and through the through-hole from the upper end to the lower end.

2. The security system of claim 1, wherein the tabs attach to the device by clipping to a portion of the device.

3. A security system for a handheld electronic device, the system comprising:

a coupler comprising a body and a terminal that protrudes from the body, wherein the body comprises a flat portion extending away from the terminal and a curved portion at an end of the flat portion for extending around the side of a device;

a connector coupled to the curved portion for connecting to the device, wherein the connector extends in a direction parallel to the flat portion;

a stand comprising a post having an upper end, a lower end, and a through-hole from the upper end to the lower end, wherein an upper end of the post defines a recess for receiving at least a portion of the terminal; and a cable extending from the terminal and through the through-hole from the upper end to the lower end.

4. The security system of claim 3, further comprising the device, wherein the connector extends within a recess of the device.

5. The security system of claim 3, further comprising the device, wherein a portion of the body is attached to the device by adhesive, and wherein the flat portion of the body extending away from the terminal is not attached to the device by adhesive.

6. The security system of claim 3, further comprising the device, wherein there is no gap between the body and the device.

7. A security system for a handheld electronic device, the system comprising:

a stand having a through-hole from a top end to a bottom end and a slot disposed at the top end;

a cable disposed through the through-hole and extending through the top and bottom ends, wherein the cable can move through the through-hole between an extended state and a non-extended state;

a coupler movably constrained to the stand, wherein the coupler has a body and a terminal protruding from the body, wherein the terminal physically interfaces with the slot of the stand and is capable of being received by the slot of the stand, wherein bottom and side surfaces of the slot have a shape and dimension that corresponds to a shape and dimension of bottom and side surfaces of the terminal, and wherein the side surfaces of the slot form the same shape as mating side surfaces of the terminal when the terminal is received by the slot; and a recoiler attached to the cable and biasing the cable, wherein the coupler is attached to a top end of the cable that extends through the top end of the stand.

8. The security system of claim 7, wherein the cable comprises an armor jacket to resist cutting.

9. The security system of claim 7, wherein the slot and the terminal have matching curvature where the slot interfaces with the terminal.

10. The security system of claim 7, wherein the terminal has a curved rear surface.

11. The security system of claim 7, wherein the recoiler biases the cable using a mechanical spring biasing mechanism.

12. A security system for a handheld electronic device, the system comprising:

a coupler having an attachment surface for attaching to a surface of a device, and a protrusion that protrudes away from the attachment surface by less than a width of the attachment surface;

a stand comprising a post having an upper end, a lower end, and a through-hole from the upper end to the lower end, wherein an upper end of the post defines a recess for receiving at least a portion of the protrusion, and wherein the upper end of the post defines an upper surface around at least a portion of the recess; and a cable extending from a center of the protrusion and through the through-hole from the upper end to the lower end, wherein the upper surface of the post is parallel to the attachment surface of the coupler when the protrusion is received by the coupler, and wherein rotation of the coupler relative to the stand is impeded when the protrusion is received within the recess.

13. The security system of claim 12, wherein the coupler comprises side tabs for attaching to a device.

14. The security system of claim 12, wherein when the protrusion is received within the recess, the cable is hidden.

* * * * *